US010729297B2

(12) United States Patent
Klintemyr et al.

(10) Patent No.: US 10,729,297 B2
(45) Date of Patent: Aug. 4, 2020

(54) ROBOTIC VACUUM CLEANER

(71) Applicant: Aktiebolaget Electrolux, Stockholm (SE)

(72) Inventors: Andreas Klintemyr, Stockholm (SE); Anders Haegermarck, Stockholm (SE); Daniel Kastensson, Stockholm (SE)

(73) Assignee: AKTIEBOLAGET ELECTROLUX, Stockholm (SE)

( * ) Notice: Subject to any disclaimer, the term of this patent is extended or adjusted under 35 U.S.C. 154(b) by 136 days.

(21) Appl. No.: 15/504,071

(22) PCT Filed: Sep. 8, 2014

(86) PCT No.: PCT/EP2014/069074
§ 371 (c)(1),
(2) Date: Feb. 15, 2017

(87) PCT Pub. No.: WO2016/037636
PCT Pub. Date: Mar. 17, 2016

(65) Prior Publication Data

US 2017/0273521 A1 Sep. 28, 2017

(51) Int. Cl.
*A47L 9/04* (2006.01)

(52) U.S. Cl.
CPC ..... *A47L 9/0466* (2013.01); *A47L 9/04* (2013.01); *A47L 9/0411* (2013.01);
(Continued)

(58) Field of Classification Search
CPC .... A47L 2201/00; A47L 2201/04; A47L 9/04; A47L 9/0411; A47L 9/0466;
(Continued)

(56) References Cited

U.S. PATENT DOCUMENTS 1,286,321 A 12/1918 Hoover
1,401,007 A 12/1921 Staples
(Continued)

FOREIGN PATENT DOCUMENTS

CA 2154758 6/1995
CN 1116818 2/1996
(Continued)

OTHER PUBLICATIONS

International Search Report and Written Opinion for International Application No. PCT/EP2015/070140, dated May 27, 2016, 11 pages.
(Continued)

*Primary Examiner* — Marc Carlson
(74) *Attorney, Agent, or Firm* — RatnerPrestia

(57) ABSTRACT

A robotic vacuum cleaner having a nozzle inlet facing a surface to be cleaned, and a rotatable side brush. The rotatable side brush has bristles extending substantially in parallel with the surface to be cleaned, and the nozzle inlet includes a frame structure forming an opening, the opening being arranged in fluid communication with a debris receptacle. The bristles extend over a side portion of the nozzle inlet. The frame structure has a base portion extending substantially in parallel with the surface to be cleaned. The base portion extends at a first level. The frame structure at the side portion extends substantially in parallel with the surface to be cleaned at a second level. The first level is arranged closer to the surface to be cleaned than the second level.

14 Claims, 2 Drawing Sheets

(52) U.S. Cl.
CPC ..... *A47L 9/0472* (2013.01); *A47L 9/0477* (2013.01); *A47L 9/0488* (2013.01); *A47L 2201/00* (2013.01); *A47L 2201/04* (2013.01); *G05D 2201/0215* (2013.01)

(58) Field of Classification Search
CPC .... A47L 9/0472; A47L 9/0477; A47L 9/0488; G05D 2201/0215
See application file for complete search history.

(56) References Cited

U.S. PATENT DOCUMENTS 1,823,128 A 9/1931 Scott
3,010,129 A 11/1961 Moore
3,233,274 A 2/1966 Kroll
3,550,714 A 12/1970 Bellinger
3,570,227 A 3/1971 Bellinger
3,713,505 A 1/1973 Muller
3,837,028 A 9/1974 Bridge
4,028,765 A 6/1977 Liebscher
4,036,147 A 7/1977 Westling
4,114,711 A 9/1978 Wilkins
4,119,900 A 10/1978 Kremnitz
4,306,174 A 12/1981 Mourier
4,306,329 A 12/1981 Yokoi
4,369,543 A 1/1983 Chen
4,502,173 A 3/1985 Patzold
4,627,511 A 12/1986 Yajima
4,647,209 A 3/1987 Neukomm
4,800,978 A 1/1989 Wasa
4,822,450 A 4/1989 Davis
4,825,091 A 4/1989 Breyer
4,836,905 A 6/1989 Davis
4,838,990 A 6/1989 Jucha
4,842,686 A 6/1989 Davis
4,849,067 A 7/1989 Jucha
4,854,000 A 8/1989 Takimoto
4,864,511 A 9/1989 Moy
4,872,938 A 10/1989 Davis
4,878,003 A 10/1989 Knepper
4,886,570 A 12/1989 Davis
4,918,607 A 4/1990 Wible
4,919,224 A 4/1990 Shyu
4,922,559 A 5/1990 Wall
4,959,192 A 9/1990 Trundle
4,962,453 A 10/1990 Pong
4,989,818 A 2/1991 Trundle
5,001,635 A 3/1991 Yasutomi
5,006,302 A 4/1991 Trundle
5,023,444 A 6/1991 Ohman
5,032,775 A 7/1991 Mizuno
5,034,673 A 7/1991 Shoji
5,042,861 A 8/1991 Trundle
5,045,118 A 9/1991 Mason
5,086,535 A 2/1992 Grossmeyer
5,095,577 A 3/1992 Jonas
5,107,946 A 4/1992 Kamimura
5,155,683 A 10/1992 Rahim
5,243,732 A 9/1993 Koharagi
5,245,177 A 9/1993 Schiller
5,276,933 A 1/1994 Hennessey
5,279,672 A 1/1994 Betker
5,293,955 A 3/1994 Lee
5,307,273 A 4/1994 Oh
5,309,592 A 5/1994 Hiratsuka
5,341,540 A 8/1994 Soupert
5,345,639 A 9/1994 Tanoue
5,349,378 A 9/1994 Maali
5,353,224 A 10/1994 Lee
5,367,458 A 11/1994 Roberts et al.
5,369,347 A 11/1994 Yoo
5,377,106 A 12/1994 Drunk
5,390,627 A 2/1995 van der Berg
5,398,632 A 3/1995 Goldbach
5,402,051 A 3/1995 Fujiwara
5,440,216 A 8/1995 Kim
5,444,965 A 8/1995 Colens
5,446,356 A 8/1995 Kim
5,454,129 A 10/1995 Kell
5,518,552 A 5/1996 Tanoue
5,534,762 A 7/1996 Kim
5,548,511 A 8/1996 Bancroft
5,560,077 A 10/1996 Crotchett
5,568,589 A 10/1996 Hwang
5,621,291 A 4/1997 Lee
5,646,494 A 7/1997 Han
5,666,689 A 9/1997 Andersen
5,682,313 A 10/1997 Edlund
5,682,640 A 11/1997 Han
5,687,294 A 11/1997 Jeong
5,698,957 A 12/1997 Sowada
5,745,946 A 5/1998 Thrasher
5,758,298 A 5/1998 Guldner
5,778,554 A 7/1998 Jones
5,781,960 A 7/1998 Kilstrom
5,787,545 A 8/1998 Colens
5,815,880 A 10/1998 Nakanishi
5,825,981 A 10/1998 Matsuda
5,841,259 A 11/1998 Kim
5,852,984 A 12/1998 Matsuyama
5,867,800 A 2/1999 Leif
5,890,250 A 4/1999 Lange
5,896,488 A 4/1999 Jeong
5,903,124 A 5/1999 Kawakami
5,926,909 A 7/1999 McGee
5,933,902 A 8/1999 Frey
5,935,179 A 8/1999 Kleiner
5,940,927 A 8/1999 Haegermarck
5,942,869 A 8/1999 Katou
5,947,051 A 9/1999 Geiger
5,959,423 A 9/1999 Nakanishi
5,959,424 A 9/1999 Elkmann
5,966,765 A 10/1999 Hamada
RE36,391 E 11/1999 vandenBerg
5,983,833 A 11/1999 van der Lely
5,987,696 A 11/1999 Wang
5,991,951 A 11/1999 Kubo
5,995,884 A 11/1999 Allen
5,997,670 A 12/1999 Walter
5,999,865 A 12/1999 Bloomquist et al.
6,012,470 A 1/2000 Jones
6,024,107 A 2/2000 Jones
6,064,926 A 5/2000 Sarangapani
6,076,662 A 6/2000 Bahten
6,082,377 A 7/2000 Frey
6,124,694 A 9/2000 Bancroft
6,142,252 A 11/2000 Kinto
6,176,067 B1 1/2001 Bahten
6,213,136 B1 4/2001 Jones
6,226,830 B1 5/2001 Hendriks
6,230,360 B1 5/2001 Singleton
6,251,551 B1 6/2001 Kunze-Concewitz
6,255,793 B1 7/2001 Peless
6,263,989 B1 7/2001 Won
6,300,737 B1 10/2001 Bergvall
6,311,366 B1 11/2001 Sepke
6,327,741 B1 12/2001 Reed
6,339,735 B1 1/2002 Peless
6,358,325 B1 3/2002 Andreas
6,360,801 B1 3/2002 Walter
6,370,452 B1 4/2002 Pfister
6,370,453 B2 4/2002 Sommer
6,381,801 B1 5/2002 Clemons, Sr.
6,389,329 B1 5/2002 Colens
6,413,149 B1 7/2002 Wada
6,417,641 B2 7/2002 Peless
6,431,296 B1 8/2002 Won
6,438,456 B1 8/2002 Feddema
6,443,509 B1 9/2002 Levin
6,457,199 B1 10/2002 Frost
6,457,206 B1 10/2002 Judson
6,459,955 B1 10/2002 Bartsch
6,465,982 B1 10/2002 Bergvall
6,481,515 B1 11/2002 Kirkpatrick

(56) References Cited

U.S. PATENT DOCUMENTS

| | | | |
|---|---|---|---|
| 6,482,678 | B1 | 11/2002 | Frost |
| 6,493,612 | B1 | 12/2002 | Bisset |
| 6,493,613 | B2 | 12/2002 | Peless |
| 6,496,754 | B2 | 12/2002 | Song |
| 6,504,610 | B1 | 1/2003 | Bauer |
| 6,519,804 | B1 | 2/2003 | Vujik |
| 6,525,509 | B1 | 2/2003 | Petersson |
| D471,243 | S | 3/2003 | Cioffi |
| 6,532,404 | B2 | 3/2003 | Colens |
| 6,535,793 | B2 | 3/2003 | Allard |
| 6,571,415 | B2 | 6/2003 | Gerber |
| 6,580,246 | B2 | 6/2003 | Jacobs |
| 6,581,239 | B1 | 6/2003 | Dyson |
| 6,594,844 | B2 | 7/2003 | Jones |
| 6,597,143 | B2 | 7/2003 | Song |
| 6,601,265 | B1 | 8/2003 | Burlington |
| 6,605,156 | B1 | 8/2003 | Clark |
| 6,609,962 | B1 | 8/2003 | Wakabayashi |
| 6,611,120 | B2 | 8/2003 | Song |
| 6,611,318 | B2 | 8/2003 | LaPolice |
| 6,615,108 | B1 | 9/2003 | Peless |
| 6,615,885 | B1 | 9/2003 | Ohm |
| 6,633,150 | B1 | 10/2003 | Wallach |
| 6,637,446 | B2 | 10/2003 | Frost |
| 6,658,325 | B2 | 12/2003 | Zweig |
| 6,661,239 | B1 | 12/2003 | Ozick |
| 6,662,889 | B2 | 12/2003 | De Fazio |
| 6,667,592 | B2 | 12/2003 | Jacobs |
| 6,668,951 | B2 | 12/2003 | Won |
| 6,671,592 | B1 | 12/2003 | Bisset |
| 6,690,134 | B1 | 2/2004 | Jones |
| 6,726,823 | B1 | 4/2004 | Wang |
| 6,732,826 | B2 | 5/2004 | Song |
| 6,745,431 | B2 | 6/2004 | Dijksman |
| 6,748,297 | B2 | 6/2004 | Song |
| 6,769,004 | B2 | 7/2004 | Barrett |
| 6,774,596 | B1 | 8/2004 | Bisset |
| 6,775,871 | B1 | 8/2004 | Finch |
| 6,781,338 | B2 | 8/2004 | Jones |
| 6,809,490 | B2 | 10/2004 | Jones |
| 6,810,305 | B2 | 10/2004 | Kirkpatrick, Jr. |
| 6,820,801 | B2 | 11/2004 | Kaneko |
| 6,841,963 | B2 | 1/2005 | Song |
| 6,845,297 | B2 | 1/2005 | Allard |
| 6,850,024 | B2 | 2/2005 | Peless |
| 6,859,010 | B2 | 2/2005 | Jeon |
| 6,859,976 | B2 | 3/2005 | Plankenhorn |
| 6,860,206 | B1 | 3/2005 | Rudakevych |
| 6,868,307 | B2 | 3/2005 | Song |
| 6,869,633 | B2 | 3/2005 | Sus |
| 6,870,792 | B2 | 3/2005 | Chiappetta |
| 6,882,334 | B1 | 4/2005 | Meyer |
| 6,883,201 | B2 | 4/2005 | Jones |
| 6,885,912 | B2 | 4/2005 | Peless |
| 6,901,624 | B2 | 6/2005 | Mori |
| 6,925,679 | B2 | 8/2005 | Wallach |
| D510,066 | S | 9/2005 | Hickey |
| 6,938,298 | B2 | 9/2005 | Aasen |
| 6,939,208 | B2 | 9/2005 | Kamimura |
| 6,940,291 | B1 | 9/2005 | Ozick |
| 6,941,199 | B1 | 9/2005 | Bottomley |
| 6,942,548 | B2 | 9/2005 | Wada |
| 6,956,348 | B2 | 10/2005 | Landry |
| 6,957,712 | B2 | 10/2005 | Song |
| 6,964,312 | B2 | 11/2005 | Maggio |
| 6,965,209 | B2 | 11/2005 | Jones |
| 6,967,275 | B2 | 11/2005 | Ozick |
| 6,971,140 | B2 | 12/2005 | Kim |
| 6,971,141 | B1 | 12/2005 | Tak |
| 6,984,952 | B2 | 1/2006 | Peless |
| 7,000,623 | B2 | 2/2006 | Welsh |
| 7,004,269 | B2 | 2/2006 | Song |
| 7,013,200 | B2 | 3/2006 | Wakui |
| 7,013,527 | B2 | 3/2006 | Thomas, Sr. |
| 7,015,831 | B2 | 3/2006 | Karlsson |
| 7,024,278 | B2 | 4/2006 | Chiappetta |
| 7,031,805 | B2 | 4/2006 | Lee |
| 7,040,968 | B2 | 5/2006 | Kamimura |
| 7,042,342 | B2 | 5/2006 | Luo |
| 7,043,794 | B2 | 5/2006 | Conner |
| 7,050,926 | B2 | 5/2006 | Theurer et al. |
| 7,053,578 | B2 | 5/2006 | Diehl et al. |
| 7,053,580 | B2 | 5/2006 | Aldred |
| 7,054,716 | B2 | 5/2006 | McKee |
| 7,059,012 | B2 | 6/2006 | Song |
| 7,079,923 | B2 | 7/2006 | Abramson |
| 7,082,350 | B2 | 7/2006 | Skoog |
| D526,753 | S | 8/2006 | Tani |
| 7,085,624 | B2 | 8/2006 | Aldred |
| 7,103,449 | B2 | 9/2006 | Woo |
| 7,113,847 | B2 | 9/2006 | Chmura |
| 7,117,067 | B2 | 10/2006 | McLurkin |
| 7,133,745 | B2 | 11/2006 | Wang |
| 7,134,164 | B2 | 11/2006 | Alton |
| 7,135,992 | B2 | 11/2006 | Karlsson |
| 7,143,696 | B2 | 12/2006 | Rudakevych |
| 7,145,478 | B2 | 12/2006 | Goncalves |
| 7,150,068 | B1 | 12/2006 | Ragner |
| 7,155,308 | B2 | 12/2006 | Jones |
| 7,155,309 | B2 | 12/2006 | Peless |
| 7,162,338 | B2 | 1/2007 | Goncalves |
| 7,167,775 | B2 | 1/2007 | Abramson |
| 7,173,391 | B2 | 2/2007 | Jones |
| 7,174,238 | B1 | 2/2007 | Zweig |
| 7,177,737 | B2 | 2/2007 | Karlsson |
| 7,184,586 | B2 | 2/2007 | Jeon |
| 7,185,396 | B2 | 3/2007 | Im |
| 7,185,397 | B2 | 3/2007 | Stuchlik |
| 7,188,000 | B2 | 3/2007 | Chiappetta |
| 7,196,487 | B2 | 3/2007 | Jones |
| 7,199,711 | B2 | 4/2007 | Field |
| 7,200,892 | B2 | 4/2007 | Kim |
| 7,202,630 | B2 | 4/2007 | Dan |
| 7,206,677 | B2 | 4/2007 | Hulden |
| 7,207,081 | B2 | 4/2007 | Gerber |
| 7,208,892 | B2 | 4/2007 | Tondra |
| 7,213,298 | B2 | 5/2007 | Cipolla |
| 7,213,663 | B2 | 5/2007 | Kim |
| 7,222,390 | B2 | 5/2007 | Cipolla |
| 7,225,500 | B2 | 6/2007 | Diehl |
| 7,237,298 | B2 | 7/2007 | Reindle |
| 7,240,396 | B2 | 7/2007 | Thomas, Sr. |
| 7,246,405 | B2 | 7/2007 | Yan |
| 7,248,951 | B2 | 7/2007 | Hulden |
| 7,251,853 | B2 | 8/2007 | Park |
| 7,254,464 | B1 | 8/2007 | McLurkin |
| 7,254,859 | B2 | 8/2007 | Gerber |
| 7,269,877 | B2 | 9/2007 | Tondra |
| 7,272,467 | B2 | 9/2007 | Goncalves |
| 7,272,868 | B2 | 9/2007 | Im |
| 7,274,167 | B2 | 9/2007 | Kim |
| 7,275,280 | B2 | 10/2007 | Haegermarck |
| 7,288,912 | B2 | 10/2007 | Landry |
| D556,961 | S | 12/2007 | Swyst |
| 7,303,776 | B2 | 12/2007 | Sus |
| 7,324,870 | B2 | 1/2008 | Lee |
| 7,331,436 | B1 | 2/2008 | Pack |
| 7,332,890 | B2 | 2/2008 | Cohen |
| 7,343,221 | B2 | 3/2008 | Ann |
| 7,343,719 | B2 | 3/2008 | Sus |
| 7,346,428 | B1 | 3/2008 | Huffman |
| 7,349,759 | B2 | 3/2008 | Peless |
| 7,359,766 | B2 | 4/2008 | Jeon |
| 7,363,994 | B1 | 4/2008 | DeFazio |
| 7,369,460 | B2 | 5/2008 | Chiappetta |
| 7,372,004 | B2 | 5/2008 | Buchner |
| 7,388,343 | B2 | 6/2008 | Jones |
| 7,389,156 | B2 | 6/2008 | Ziegler |
| 7,389,166 | B2 | 6/2008 | Harwig |
| 7,403,360 | B2 | 7/2008 | Cunningham |
| 7,412,748 | B2 | 8/2008 | Lee |
| 7,417,404 | B2 | 8/2008 | Lee |
| 7,418,762 | B2 | 9/2008 | Arai |
| 7,424,766 | B2 | 9/2008 | Reindle |

(56) References Cited

U.S. PATENT DOCUMENTS

| | | | |
|---|---|---|---|
| 7,429,843 | B2 | 9/2008 | Jones |
| 7,430,455 | B2 | 9/2008 | Casey |
| 7,438,766 | B2 | 10/2008 | Song |
| 7,441,298 | B2 | 10/2008 | Svendsen |
| 7,444,206 | B2 | 10/2008 | Abramson |
| 7,448,113 | B2 | 11/2008 | Jones |
| 7,459,871 | B2 | 12/2008 | Landry |
| 7,464,157 | B2 | 12/2008 | Okude |
| 7,474,941 | B2 | 1/2009 | Kim |
| 7,480,958 | B2 | 1/2009 | Song |
| 7,480,960 | B2 | 1/2009 | Kim |
| D586,959 | S | 2/2009 | Geringer |
| 7,489,277 | B2 | 2/2009 | Sung |
| 7,489,985 | B2 | 2/2009 | Ko |
| 7,499,774 | B2 | 3/2009 | Barrett |
| 7,499,775 | B2 | 3/2009 | Filippov |
| 7,499,776 | B2 | 3/2009 | Allard |
| 7,499,804 | B2 | 3/2009 | Svendsen |
| 7,503,096 | B2 | 3/2009 | Lin |
| 7,515,991 | B2 | 4/2009 | Egawa |
| D593,265 | S | 5/2009 | Carr |
| 7,539,557 | B2 | 5/2009 | Yamauchi |
| 7,546,891 | B2 | 6/2009 | Won |
| 7,546,912 | B1 | 6/2009 | Pack |
| 7,555,363 | B2 | 6/2009 | Augenbraun |
| 7,556,108 | B2 | 7/2009 | Won |
| 7,559,269 | B2 | 7/2009 | Rudakevych |
| 7,564,571 | B2 | 7/2009 | Karabassi |
| 7,566,839 | B2 | 7/2009 | Hukuba |
| 7,567,052 | B2 | 7/2009 | Jones |
| 7,568,259 | B2 | 8/2009 | Yan |
| 7,568,536 | B2 | 8/2009 | Yu |
| 7,571,511 | B2 | 8/2009 | Jones |
| 7,573,403 | B2 | 8/2009 | Goncalves |
| 7,574,282 | B2 | 8/2009 | Petersson |
| 7,578,020 | B2 | 8/2009 | Jaworski |
| 7,579,803 | B2 | 8/2009 | Jones |
| 7,581,282 | B2 | 9/2009 | Woo |
| 7,597,162 | B2 | 10/2009 | Won |
| 7,600,521 | B2 | 10/2009 | Woo |
| 7,600,593 | B2 | 10/2009 | Filippov |
| 7,603,744 | B2 | 10/2009 | Reindle |
| 7,604,675 | B2 | 10/2009 | Makarov |
| 7,610,651 | B2 | 11/2009 | Baek |
| 7,613,543 | B2 | 11/2009 | Petersson |
| 7,620,476 | B2 | 11/2009 | Morse |
| 7,636,982 | B2 | 12/2009 | Jones |
| 7,647,144 | B2 | 1/2010 | Haegermarck |
| 7,650,666 | B2 | 1/2010 | Jang |
| 7,654,348 | B2 | 2/2010 | Ohm |
| 7,660,650 | B2 | 2/2010 | Kawagoe |
| 7,663,333 | B2 | 2/2010 | Jones |
| 7,673,367 | B2 | 3/2010 | Kim |
| 7,679,532 | B2 | 3/2010 | Karlsson |
| 7,688,676 | B2 | 3/2010 | Chiappetta |
| 7,693,654 | B1 | 4/2010 | Dietsch |
| 7,697,141 | B2 | 4/2010 | Jones |
| 7,706,917 | B1 | 4/2010 | Chiappetta |
| 7,706,921 | B2 | 4/2010 | Jung |
| 7,709,497 | B2 | 5/2010 | Christensen, IV |
| 7,711,450 | B2 | 5/2010 | Im |
| 7,720,572 | B2 | 5/2010 | Ziegler |
| 7,721,829 | B2 | 5/2010 | Lee |
| 7,729,801 | B2 | 6/2010 | Abramson |
| 7,749,294 | B2 | 7/2010 | Oh |
| 7,751,940 | B2 | 7/2010 | Lee |
| 7,761,954 | B2 | 7/2010 | Ziegler |
| 7,765,635 | B2 | 8/2010 | Park |
| 7,765,638 | B2 | 8/2010 | Pineschi et al. |
| 7,769,490 | B2 | 8/2010 | Abramson |
| 7,774,158 | B2 | 8/2010 | Domingues Goncalves |
| 7,779,504 | B2 | 8/2010 | Lee |
| 7,780,796 | B2 | 8/2010 | Shim |
| 7,784,139 | B2 | 8/2010 | Sawalski |
| 7,784,570 | B2 | 8/2010 | Couture |
| 7,785,544 | B2 | 8/2010 | Alward |
| 7,787,991 | B2 | 8/2010 | Jeung |
| 7,793,614 | B2 | 9/2010 | Ericsson |
| 7,801,645 | B2 | 9/2010 | Taylor |
| 7,805,220 | B2 | 9/2010 | Taylor |
| 7,827,653 | B1 | 11/2010 | Liu |
| 7,832,048 | B2 | 11/2010 | Harwig |
| 7,835,529 | B2 | 11/2010 | Hernandez |
| 7,843,431 | B2 | 11/2010 | Robbins |
| 7,844,364 | B2 | 11/2010 | McLurkin |
| 7,849,555 | B2 | 12/2010 | Hahm |
| 7,856,291 | B2 | 12/2010 | Jung |
| 7,860,608 | B2 | 12/2010 | Lee |
| 7,861,365 | B2 | 1/2011 | Sun |
| 7,861,366 | B2 | 1/2011 | Hahm |
| 7,873,437 | B2 | 1/2011 | Aldred |
| 7,877,166 | B2 | 1/2011 | Harwig |
| 7,886,399 | B2 | 2/2011 | Dayton |
| 7,890,210 | B2 | 2/2011 | Choi |
| 7,891,045 | B2 | 2/2011 | Kim |
| 7,891,289 | B2 | 2/2011 | Day |
| 7,891,446 | B2 | 2/2011 | Couture |
| 7,894,951 | B2 | 2/2011 | Norris |
| 7,916,931 | B2 | 3/2011 | Lee |
| 7,920,941 | B2 | 4/2011 | Park |
| 7,921,506 | B2 | 4/2011 | Baek |
| 7,926,598 | B2 | 4/2011 | Rudakevych |
| 7,934,571 | B2 | 5/2011 | Chiu |
| 7,937,800 | B2 | 5/2011 | Yan |
| 7,942,107 | B2 | 5/2011 | Vosburgh |
| 7,957,837 | B2 | 6/2011 | Ziegler |
| 7,962,997 | B2 | 6/2011 | Chung |
| 7,966,339 | B2 | 6/2011 | Kim |
| 7,975,790 | B2 | 7/2011 | Kim |
| 7,979,175 | B2 | 7/2011 | Allard |
| 7,979,945 | B2 | 7/2011 | Dayton |
| 7,981,455 | B2 | 7/2011 | Sus |
| 7,997,118 | B2 | 8/2011 | Mecca |
| 8,001,651 | B2 | 8/2011 | Chang |
| 8,007,221 | B1 | 8/2011 | More |
| 8,010,229 | B2 | 8/2011 | Kim |
| 8,019,223 | B2 | 9/2011 | Hudson |
| 8,020,657 | B2 | 9/2011 | Allard |
| 8,032,978 | B2 | 10/2011 | Haegermarck |
| 8,034,390 | B2 | 10/2011 | Sus |
| 8,042,663 | B1 | 10/2011 | Pack |
| 8,046,103 | B2 | 10/2011 | Abramson |
| 8,061,461 | B2 | 11/2011 | Couture |
| 8,065,778 | B2 | 11/2011 | Kim |
| 8,073,439 | B2 | 12/2011 | Stromberg |
| 8,074,752 | B2 | 12/2011 | Rudakevych |
| 8,078,338 | B2 | 12/2011 | Pack |
| 8,079,432 | B2 | 12/2011 | Ohm |
| 8,082,836 | B2 | 12/2011 | More |
| 8,086,419 | B2 | 12/2011 | Goncalves |
| 8,087,117 | B2 | 1/2012 | Kapoor |
| 8,095,238 | B2 | 1/2012 | Jones |
| 8,095,336 | B2 | 1/2012 | Goncalves |
| 8,107,318 | B2 | 1/2012 | Chiappetta |
| 8,108,092 | B2 | 1/2012 | Phillips |
| 8,109,191 | B1 | 2/2012 | Rudakevych |
| 8,112,942 | B2 | 2/2012 | Bohm |
| 8,113,304 | B2 | 2/2012 | Won |
| 8,122,982 | B2 | 2/2012 | Morey |
| 8,127,396 | B2 | 3/2012 | Mangiardi |
| 8,127,399 | B2 | 3/2012 | Dilger |
| 8,127,704 | B2 | 3/2012 | Vosburgh |
| 8,136,200 | B2 | 3/2012 | Splinter |
| 8,150,650 | B2 | 4/2012 | Goncalves |
| D659,311 | S | 5/2012 | Geringer |
| 8,166,904 | B2 | 5/2012 | Israel |
| 8,195,333 | B2 | 6/2012 | Ziegler |
| 8,196,251 | B2 | 6/2012 | Lynch |
| 8,199,109 | B2 | 6/2012 | Robbins |
| 8,200,600 | B2 | 6/2012 | Rosenstein |
| 8,200,700 | B2 | 6/2012 | Moore |
| 8,237,389 | B2 | 8/2012 | Fitch |
| 8,237,920 | B2 | 8/2012 | Jones |
| 8,239,992 | B2 | 8/2012 | Schnittman |

(56) References Cited

U.S. PATENT DOCUMENTS 8,244,469 B2 8/2012 Cheung
8,253,368 B2 8/2012 Landry
8,255,092 B2 8/2012 Phillips
8,256,542 B2 9/2012 Couture
8,265,793 B2 9/2012 Cross
8,274,406 B2 9/2012 Karlsson
8,281,703 B2 10/2012 Moore
8,281,731 B2 10/2012 Vosburgh
8,290,619 B2 10/2012 McLurkin
8,292,007 B2 10/2012 DeFazio
8,295,125 B2 10/2012 Chiappetta
D670,877 S 11/2012 Geringer
8,308,529 B2 11/2012 DAmbra
8,311,674 B2 11/2012 Abramson
8,316,971 B2 11/2012 Couture
8,318,499 B2 11/2012 Fritchie
D672,928 S 12/2012 Swett
8,322,470 B2 12/2012 Ohm
8,326,469 B2 12/2012 Phillips
8,327,960 B2 12/2012 Couture
8,336,479 B2 12/2012 Vosburgh
8,342,271 B2 1/2013 Filippov
8,347,088 B2 1/2013 Moore
8,347,444 B2 1/2013 Schnittman
8,350,810 B2 1/2013 Robbins
8,353,373 B2 1/2013 Rudakevych
8,364,309 B1 1/2013 Bailey
8,364,310 B2 1/2013 Jones
8,365,848 B2 2/2013 Won
8,368,339 B2 2/2013 Jones
8,370,985 B2 2/2013 Schnittman
8,374,721 B2 2/2013 Halloran
8,375,838 B2 2/2013 Rudakevych
8,378,613 B2 2/2013 Landry
8,380,350 B2 * 2/2013 Ozick ..... A47L 5/30 700/253
8,382,906 B2 2/2013 Konandreas
8,386,081 B2 2/2013 Landry
8,387,193 B2 3/2013 Ziegler
8,390,251 B2 3/2013 Cohen
8,392,021 B2 3/2013 Konandreas
8,396,592 B2 3/2013 Jones
8,396,611 B2 3/2013 Phillips
8,402,586 B2 3/2013 Lavabre
8,408,956 B1 4/2013 Vosburgh
8,412,377 B2 4/2013 Casey
8,413,752 B2 4/2013 Page
8,417,188 B1 4/2013 Vosburgh
8,417,383 B2 4/2013 Ozick
8,418,303 B2 4/2013 Kapoor
8,418,642 B2 4/2013 Vosburgh
8,428,778 B2 4/2013 Landry
8,433,442 B2 4/2013 Friedman
D682,362 S 5/2013 Mozeika
8,438,694 B2 5/2013 Kim
8,438,695 B2 5/2013 Gilbert, Jr.
8,438,698 B2 5/2013 Kim
8,447,440 B2 5/2013 Phillips
8,447,613 B2 5/2013 Hussey
8,452,448 B2 5/2013 Pack
8,453,289 B2 6/2013 Lynch
8,456,125 B2 6/2013 Landry
8,461,803 B2 6/2013 Cohen
8,463,438 B2 6/2013 Jones
8,473,140 B2 6/2013 Norris
8,474,090 B2 7/2013 Jones
8,478,442 B2 7/2013 Casey
8,485,330 B2 7/2013 Pack
8,505,158 B2 8/2013 Han
8,508,388 B2 8/2013 Karlsson
8,515,578 B2 8/2013 Chiappetta
8,516,651 B2 8/2013 Jones
8,525,995 B2 9/2013 Jones
8,527,113 B2 9/2013 Yamauchi
8,528,157 B2 9/2013 Schnittman
8,528,162 B2 9/2013 Tang
8,528,673 B2 9/2013 More
8,532,822 B2 9/2013 Abramson
8,533,144 B1 9/2013 Reeser
8,534,983 B2 9/2013 Schoenfeld
8,543,562 B2 9/2013 Mule
8,548,626 B2 10/2013 Steltz
8,551,254 B2 10/2013 Dayton
8,551,421 B2 10/2013 Luchinger
8,565,920 B2 10/2013 Casey
8,572,799 B2 11/2013 Won
8,584,305 B2 11/2013 Won
8,584,306 B2 11/2013 Chung
8,584,307 B2 11/2013 Won
8,594,840 B1 11/2013 Chiappetta
8,598,829 B2 12/2013 Landry
8,599,645 B2 12/2013 Chiappetta
8,600,553 B2 12/2013 Svendsen
8,606,401 B2 12/2013 Ozick
8,634,956 B1 1/2014 Chiappetta
8,634,958 B1 1/2014 Chiappetta
8,666,523 B2 3/2014 Kim
8,671,513 B2 3/2014 Yoo et al.
8,732,895 B2 5/2014 Cunningham
8,741,013 B2 6/2014 Swett et al.
8,743,286 B2 6/2014 Hasegawa
8,745,194 B2 6/2014 Uribe-Etxebarria Jimenez
8,755,936 B2 6/2014 Friedman
8,761,931 B2 6/2014 Halloran
8,763,200 B2 7/2014 Kim
8,774,970 B2 7/2014 Knopow
8,798,791 B2 8/2014 Li
8,798,792 B2 8/2014 Park
8,799,258 B2 8/2014 Mule
8,838,274 B2 9/2014 Jones
8,839,477 B2 9/2014 Schnittman
8,843,245 B2 9/2014 Choe
8,855,914 B1 10/2014 Alexander
8,874,264 B1 10/2014 Chiappetta
8,881,339 B2 11/2014 Gilbert, Jr. et al.
8,924,042 B2 12/2014 Kim
8,961,695 B2 2/2015 Romanov
8,985,127 B2 3/2015 Konandreas
8,996,172 B2 3/2015 Shah et al.
9,033,079 B2 5/2015 Shin
9,037,396 B2 5/2015 Pack
9,144,361 B2 9/2015 Landry
9,360,300 B2 6/2016 DiBernado
9,687,132 B2 6/2017 Schlischka
10,045,675 B2 * 8/2018 Haegermarck ..... A47L 9/0488
2001/0004719 A1 6/2001 Sommer
2001/0037163 A1 11/2001 Allard
2002/0016649 A1 2/2002 Jones
2002/0091466 A1 7/2002 Song
2002/0108635 A1 8/2002 Marrero
2002/0121288 A1 9/2002 Marrero
2002/0121561 A1 9/2002 Marrero
2002/0164932 A1 11/2002 Kamimura
2002/0174506 A1 11/2002 Wallach
2002/0185071 A1 12/2002 Guo
2002/0189871 A1 12/2002 Won
2003/0000034 A1 1/2003 Welsh
2003/0025472 A1 2/2003 Jones
2003/0030398 A1 2/2003 Jacobs
2003/0120972 A1 6/2003 Matsushima
2003/0159223 A1 8/2003 Plankenhorn
2003/0167000 A1 9/2003 Mullick
2003/0229421 A1 12/2003 Chmura
2004/0020000 A1 2/2004 Jones
2004/0031111 A1 2/2004 Porchia
2004/0031121 A1 2/2004 Martin
2004/0034952 A1 2/2004 Ho
2004/0049877 A1 3/2004 Jones
2004/0049878 A1 3/2004 Thomas
2004/0074038 A1 4/2004 Im
2004/0074039 A1 4/2004 Kim
2004/0098167 A1 5/2004 Yi
2004/0111184 A1 6/2004 Chiappetta
2004/0111827 A1 6/2004 Im

(56) References Cited

U.S. PATENT DOCUMENTS

2004/0167667 A1 8/2004 Goncalves
2004/0181896 A1 9/2004 Egawa
2004/0182839 A1 9/2004 Denney
2004/0182840 A1 9/2004 Denney
2004/0185011 A1 9/2004 Alexander
2004/0187249 A1 9/2004 Jones
2004/0207355 A1 10/2004 Jones
2004/0208212 A1 10/2004 Denney
2004/0210343 A1 10/2004 Kim
2004/0220707 A1 11/2004 Pallister
2005/0010331 A1 1/2005 Taylor
2005/0015912 A1 1/2005 Kim
2005/0015915 A1 1/2005 Thomas
2005/0028315 A1 2/2005 Thomas
2005/0028316 A1 2/2005 Thomas
2005/0042151 A1 2/2005 Alward
2005/0065662 A1 3/2005 Reindle
2005/0085947 A1 4/2005 Aldred
2005/0088643 A1 4/2005 Anderson
2005/0156562 A1 7/2005 Cohen
2005/0166354 A1 8/2005 Uehigashi
2005/0172435 A1 8/2005 Bernini et al.
2005/0191949 A1 9/2005 Kamimura
2005/0217061 A1 10/2005 Reindle
2005/0223514 A1 10/2005 Stuchlik
2005/0229340 A1 10/2005 Sawalski
2005/0230166 A1 10/2005 Petersson
2005/0234611 A1 10/2005 Uehigashi
2005/0251292 A1 11/2005 Casey
2005/0251457 A1 11/2005 Kashiwagi
2005/0251947 A1 11/2005 Lee
2005/0267629 A1 12/2005 Petersson
2005/0278888 A1 12/2005 Reindle
2005/0287038 A1 12/2005 Dubrovsky
2006/0009879 A1 1/2006 Lynch
2006/0010799 A1 1/2006 Bohm
2006/0020369 A1 1/2006 Taylor
2006/0028306 A1 2/2006 Hukuba
2006/0032013 A1 2/2006 Kim
2006/0045981 A1 3/2006 Tsushi
2006/0095158 A1 5/2006 Lee
2006/0136096 A1 6/2006 Chiappetta
2006/0144834 A1 7/2006 Denney
2006/0178777 A1 8/2006 Park
2006/0190133 A1 8/2006 Konandreas
2006/0190134 A1 8/2006 Ziegler
2006/0190146 A1 8/2006 Morse
2006/0195015 A1 8/2006 Mullick
2006/0200281 A1 9/2006 Ziegler
2006/0213025 A1 9/2006 Sawalski
2006/0235570 A1 10/2006 Jung
2006/0235585 A1 10/2006 Tanaka
2006/0236492 A1 10/2006 Sudo
2006/0288519 A1 12/2006 Jaworski
2006/0293788 A1 12/2006 Pogodin
2007/0016328 A1 1/2007 Ziegler
2007/0021867 A1 1/2007 Woo
2007/0059441 A1 3/2007 Greer
2007/0061040 A1 3/2007 Augenbraun et al.
2007/0114975 A1 5/2007 Cohen
2007/0118248 A1 5/2007 Lee et al.
2007/0124890 A1 6/2007 Erko
2007/0143950 A1 6/2007 Lin
2007/0156286 A1 7/2007 Yamauchi
2007/0179670 A1 8/2007 Chiappetta
2007/0189347 A1 8/2007 Denney
2007/0204426 A1 9/2007 Nakagawa
2007/0213892 A1 9/2007 Jones
2007/0214601 A1 9/2007 Chung
2007/0234492 A1 10/2007 Svendsen
2007/0244610 A1 10/2007 Ozick
2007/0266508 A1 11/2007 Jones
2007/0267230 A1 11/2007 Won
2007/0267570 A1 11/2007 Park
2007/0267998 A1 11/2007 Cohen
2007/0273864 A1 11/2007 Cho
2007/0276541 A1 11/2007 Sawasaki
2007/0285041 A1 12/2007 Jones
2007/0289267 A1 12/2007 Makarov
2007/0290649 A1 12/2007 Jones
2008/0000041 A1 1/2008 Jones
2008/0000042 A1 1/2008 Jones
2008/0001566 A1 1/2008 Jones
2008/0007203 A1 1/2008 Cohen
2008/0009964 A1 1/2008 Bruemmer et al.
2008/0015738 A1 1/2008 Casey
2008/0016631 A1 1/2008 Casey
2008/0037170 A1 2/2008 Saliba
2008/0039974 A1 2/2008 Sandin
2008/0047092 A1 2/2008 Schnittman
2008/0051953 A1 2/2008 Jones
2008/0007193 A1 3/2008 Bow
2008/0052846 A1 3/2008 Kapoor
2008/0058987 A1 3/2008 Ozick
2008/0063400 A1 3/2008 Hudson
2008/0065265 A1 3/2008 Ozick
2008/0077278 A1 3/2008 Park
2008/0084174 A1 4/2008 Jones
2008/0086241 A1 4/2008 Phillips
2008/0091304 A1 4/2008 Ozick
2008/0091305 A1 4/2008 Svendsen
2008/0093131 A1 4/2008 Couture
2008/0098553 A1 5/2008 Dayton
2008/0105445 A1 5/2008 Dayton
2008/0109126 A1 5/2008 Sandin
2008/0121097 A1 5/2008 Rudakevych
2008/0127445 A1 6/2008 Konandreas
2008/0127446 A1 6/2008 Ziegler
2008/0133052 A1 6/2008 Jones
2008/0134457 A1 6/2008 Morse
2008/0134458 A1 6/2008 Ziegler
2008/0140255 A1 6/2008 Ziegler
2008/0143063 A1 6/2008 Won
2008/0143064 A1 6/2008 Won
2008/0143065 A1 6/2008 DeFazio
2008/0152871 A1 6/2008 Greer
2008/0155768 A1 7/2008 Ziegler
2008/0179115 A1 7/2008 Ohm
2008/0183332 A1 7/2008 Ohm
2008/0184518 A1 8/2008 Taylor
2008/0196946 A1 8/2008 Filippov
2008/0205194 A1 8/2008 Chiappetta
2008/0209665 A1 9/2008 Mangiardi
2008/0221729 A1 9/2008 Lavarec
2008/0223630 A1 9/2008 Couture
2008/0235897 A1 10/2008 Kim
2008/0236907 A1 10/2008 Won
2008/0264456 A1 10/2008 Lynch
2008/0266254 A1 10/2008 Robbins
2008/0276407 A1 11/2008 Schnittman
2008/0276408 A1 11/2008 Gilbert
2008/0281470 A1 11/2008 Gilbert
2008/0282494 A1 11/2008 Won
2008/0294288 A1 11/2008 Yamauchi
2008/0307590 A1 12/2008 Jones
2009/0007366 A1 1/2009 Svendsen
2009/0025155 A1 1/2009 Nishiyama
2009/0030551 A1 1/2009 Hein et al.
2009/0037024 A1 2/2009 Jamieson
2009/0038089 A1 2/2009 Landry
2009/0044370 A1 2/2009 Won
2009/0045766 A1 2/2009 Casey
2009/0055022 A1 2/2009 Casey
2009/0065271 A1 3/2009 Won
2009/0070946 A1 3/2009 Tamada
2009/0078035 A1 3/2009 Mecca
2009/0107738 A1 4/2009 Won
2009/0125175 A1 5/2009 Park
2009/0126143 A1* 5/2009 Haegermarck ..... A47L 9/00
15/319
2009/0133720 A1 5/2009 Vandenbogert
2009/0145671 A1 6/2009 Filippov
2009/0173553 A1 7/2009 Won
2009/0180668 A1 7/2009 Jones

(56) References Cited

U.S. PATENT DOCUMENTS

2009/0226113 A1 9/2009 Matsumoto et al.
2009/0232506 A1 9/2009 Hudson
2009/0241826 A1 10/2009 Vosburgh
2009/0254217 A1 10/2009 Pack
2009/0254218 A1 10/2009 Sandin
2009/0265036 A1 10/2009 Jamieson
2009/0270015 A1 10/2009 DAmbra
2009/0274602 A1 11/2009 Alward
2009/0281661 A1 11/2009 Dooley et al.
2009/0292393 A1 11/2009 Casey
2009/0292884 A1 11/2009 Wang
2009/0314318 A1 12/2009 Chang
2009/0314554 A1 12/2009 Couture
2009/0319083 A1 12/2009 Jones
2010/0001478 A1 1/2010 DeFazio
2010/0011529 A1 1/2010 Won
2010/0037418 A1* 2/2010 Hussey ..... A47L 5/30 15/319
2010/0049364 A1 2/2010 Landry
2010/0049365 A1 2/2010 Jones
2010/0049391 A1 2/2010 Nakano
2010/0063628 A1 3/2010 Landry
2010/0075054 A1 3/2010 Kaneyama
2010/0076600 A1 3/2010 Cross
2010/0078415 A1 4/2010 Denney
2010/0082193 A1 4/2010 Chiappetta
2010/0107355 A1 5/2010 Won
2010/0108098 A1 5/2010 Splinter
2010/0115716 A1 5/2010 Landry
2010/0116566 A1 5/2010 Ohm
2010/0125968 A1 5/2010 Ho
2010/0139029 A1 6/2010 Kim
2010/0139995 A1 6/2010 Rudakevych
2010/0161225 A1 6/2010 Hyung et al.
2010/0173070 A1 7/2010 Niu
2010/0206336 A1 8/2010 Souid
2010/0217436 A1 8/2010 Jones
2010/0257690 A1 10/2010 Jones
2010/0257691 A1 10/2010 Jones
2010/0263142 A1 10/2010 Jones
2010/0263158 A1 10/2010 Jones
2010/0268384 A1 10/2010 Jones
2010/0275405 A1 11/2010 Morse
2010/0286791 A1 11/2010 Goldsmith
2010/0305752 A1 12/2010 Abramson
2010/0312429 A1 12/2010 Jones
2010/0313910 A1 12/2010 Lee
2010/0313912 A1 12/2010 Han
2011/0000363 A1 1/2011 More
2011/0004339 A1 1/2011 Ozick
2011/0010873 A1 1/2011 Kim
2011/0077802 A1 3/2011 Halloran
2011/0082668 A1 4/2011 Escrig
2011/0088609 A1 4/2011 Vosburgh
2011/0109549 A1 5/2011 Robbins
2011/0125323 A1 5/2011 Gutmann et al.
2011/0131741 A1 6/2011 Jones
2011/0154589 A1 6/2011 Reindle
2011/0202175 A1 8/2011 Romanov
2011/0209726 A1 9/2011 Dayton
2011/0252594 A1 10/2011 Blouin
2011/0258789 A1 10/2011 Lavabre
2011/0271469 A1 11/2011 Ziegler
2011/0277269 A1 11/2011 Kim
2011/0286886 A1 11/2011 Luchinger
2011/0288684 A1 11/2011 Farlow
2012/0011668 A1 1/2012 Schnittman
2012/0011669 A1 1/2012 Schnittman
2012/0011676 A1 1/2012 Jung
2012/0011677 A1 1/2012 Jung
2012/0011992 A1 1/2012 Rudakevych
2012/0036659 A1 2/2012 Ziegler
2012/0047676 A1 3/2012 Jung
2012/0049798 A1 3/2012 Cohen
2012/0079670 A1 4/2012 Yoon
2012/0083924 A1 4/2012 Jones
2012/0084934 A1 4/2012 Li
2012/0084937 A1 4/2012 Won
2012/0084938 A1 4/2012 Fu
2012/0085368 A1 4/2012 Landry
2012/0090133 A1 4/2012 Kim
2012/0095619 A1 4/2012 Pack
2012/0096656 A1 4/2012 Jung
2012/0097783 A1 4/2012 Pack
2012/0101661 A1 4/2012 Phillips
2012/0102670 A1 5/2012 Jang
2012/0109423 A1 5/2012 Pack
2012/0110755 A1 5/2012 Liu
2012/0118216 A1 5/2012 Vosburgh
2012/0125363 A1 5/2012 Kim
2012/0137464 A1 6/2012 Thatcher
2012/0137949 A1 6/2012 Vosburgh
2012/0151709 A1 6/2012 Tang
2012/0152280 A1 6/2012 Bosses
2012/0152877 A1 6/2012 Tadayon
2012/0159725 A1 6/2012 Kapoor
2012/0166024 A1 6/2012 Phillips
2012/0167917 A1 7/2012 Gilbert
2012/0169497 A1 7/2012 Schnittman
2012/0173018 A1 7/2012 Allen
2012/0173070 A1 7/2012 Schnittman
2012/0180254 A1 7/2012 Morse
2012/0180712 A1 7/2012 Vosburgh
2012/0181099 A1 7/2012 Moon
2012/0182392 A1 7/2012 Kearns
2012/0183382 A1 7/2012 Couture
2012/0185091 A1 7/2012 Field
2012/0185094 A1 7/2012 Rosenstein
2012/0185095 A1 7/2012 Rosenstein
2012/0185096 A1 7/2012 Rosenstein
2012/0192898 A1 8/2012 Lynch
2012/0194395 A1 8/2012 Williams
2012/0197439 A1 8/2012 Wang
2012/0197464 A1 8/2012 Wang
2012/0199006 A1 8/2012 Swett
2012/0199407 A1 8/2012 Morey
2012/0200149 A1 8/2012 Rudakevych
2012/0222224 A1 9/2012 Yoon
2012/0246862 A1 10/2012 Landry
2012/0260443 A1 10/2012 Lindgren
2012/0260861 A1 10/2012 Lindgren
2012/0261204 A1 10/2012 Won
2012/0265346 A1 10/2012 Gilbert
2012/0265391 A1 10/2012 Letsky
2012/0268587 A1 10/2012 Robbins
2012/0281829 A1 11/2012 Rudakevych
2012/0298029 A1 11/2012 Vosburgh
2012/0303160 A1 11/2012 Ziegler
2012/0311810 A1 12/2012 Gilbert
2012/0312221 A1 12/2012 Vosburgh
2012/0317745 A1 12/2012 Jung
2012/0322349 A1 12/2012 Josi
2013/0015596 A1 1/2013 Mozeika
2013/0025085 A1 1/2013 Kim
2013/0031734 A1 2/2013 Porat
2013/0032078 A1 2/2013 Yahnker
2013/0035793 A1 2/2013 Neumann
2013/0047368 A1 2/2013 Tran
2013/0054029 A1 2/2013 Huang
2013/0054129 A1 2/2013 Wong
2013/0060357 A1 3/2013 Li
2013/0060379 A1 3/2013 Choe
2013/0070563 A1 3/2013 Chiappetta
2013/0081218 A1 4/2013 Kim
2013/0085603 A1 4/2013 Chiappetta
2013/0086760 A1 4/2013 Han
2013/0092190 A1 4/2013 Yoon
2013/0098402 A1 4/2013 Yoon
2013/0103194 A1 4/2013 Jones
2013/0105233 A1 5/2013 Couture
2013/0117952 A1 5/2013 Schnittman
2013/0118524 A1 5/2013 Konandreas
2013/0138337 A1 5/2013 Pack
2013/0145572 A1 6/2013 Schregardus

(56) References Cited

U.S. PATENT DOCUMENTS

| | | | |
|---|---|---|---|
| 2013/0152724 | A1 | 6/2013 | Mozeika |
| 2013/0160226 | A1 | 6/2013 | Lee |
| 2013/0166107 | A1 | 6/2013 | Robbins |
| 2013/0174371 | A1 | 7/2013 | Jones |
| 2013/0204463 | A1 | 8/2013 | Chiappetta |
| 2013/0204465 | A1 | 8/2013 | Phillips |
| 2013/0204483 | A1 | 8/2013 | Sung |
| 2013/0205520 | A1 | 8/2013 | Kapoor |
| 2013/0206170 | A1 | 8/2013 | Svendsen |
| 2013/0206177 | A1 | 8/2013 | Burlutskiy |
| 2013/0211589 | A1 | 8/2013 | Landry |
| 2013/0214498 | A1 | 8/2013 | DeFazio |
| 2013/0226344 | A1 | 8/2013 | Wong |
| 2013/0227801 | A1 | 9/2013 | Kim |
| 2013/0227812 | A1 | 9/2013 | Kim |
| 2013/0228198 | A1 | 9/2013 | Hung et al. |
| 2013/0228199 | A1 | 9/2013 | Hung |
| 2013/0231779 | A1 | 9/2013 | Purkayastha |
| 2013/0231819 | A1 | 9/2013 | Hung |
| 2013/0232702 | A1 | 9/2013 | Baek |
| 2013/0239870 | A1 | 9/2013 | Hudson |
| 2013/0241217 | A1 | 9/2013 | Hickey |
| 2013/0253701 | A1 | 9/2013 | Halloran |
| 2013/0256042 | A1 | 10/2013 | Rudakevych |
| 2013/0268118 | A1 | 10/2013 | Grinstead |
| 2013/0269148 | A1 | 10/2013 | Chiu |
| 2013/0273252 | A1 | 10/2013 | Miyamoto |
| 2013/0298350 | A1 | 11/2013 | Schnittman |
| 2013/0310978 | A1 | 11/2013 | Ozick |
| 2013/0325178 | A1 | 12/2013 | Jones |
| 2013/0331987 | A1 | 12/2013 | Karlsson |
| 2013/0338525 | A1 | 12/2013 | Allen |
| 2013/0338828 | A1 | 12/2013 | Chiappetta |
| 2013/0338831 | A1 | 12/2013 | Noh et al. |
| 2013/0340201 | A1* | 12/2013 | Jang ..... A47L 9/009 15/319 |
| 2014/0016469 | A1 | 1/2014 | Ho |
| 2014/0026338 | A1* | 1/2014 | Kim ..... A47L 11/4041 15/49.1 |
| 2014/0026339 | A1 | 1/2014 | Konandreas |
| 2014/0053351 | A1 | 2/2014 | Kapoor |
| 2014/0109339 | A1 | 4/2014 | Won |
| 2014/0123325 | A1 | 5/2014 | Jung |
| 2014/0130272 | A1 | 5/2014 | Won |
| 2014/0142757 | A1 | 5/2014 | Ziegler |
| 2014/0167931 | A1 | 6/2014 | Lee |
| 2014/0180968 | A1 | 6/2014 | Song |
| 2014/0207280 | A1 | 7/2014 | Duffley |
| 2014/0207281 | A1 | 7/2014 | Angle |
| 2014/0207282 | A1 | 7/2014 | Angle |
| 2014/0238440 | A1 | 8/2014 | Dayton |
| 2014/0249671 | A1 | 9/2014 | Halloran |
| 2014/0283326 | A1 | 9/2014 | Song |
| 2015/0005937 | A1 | 1/2015 | Ponulak |
| 2015/0032259 | A1 | 1/2015 | Kim et al. |
| 2015/0033488 | A1 | 2/2015 | Varila |
| 2015/0039127 | A1 | 2/2015 | Matsumoto |
| 2015/0057800 | A1 | 2/2015 | Cohen |
| 2015/0120056 | A1 | 4/2015 | Noh et al. |
| 2015/0197012 | A1 | 7/2015 | Schnittman |
| 2015/0206015 | A1 | 7/2015 | Ramalingam et al. |
| 2015/0265122 | A1 | 9/2015 | Han et al. |
| 2016/0306359 | A1 | 10/2016 | Lindhe |
| 2016/0316982 | A1* | 11/2016 | Kim ..... A47L 9/2857 |
| 2017/0273521 | A1 | 9/2017 | Klintemyr et al. |
| 2017/0273524 | A1* | 9/2017 | Klintemyr ..... A47L 9/0411 |
| 2018/0103812 | A1 | 4/2018 | Lee et al. |

FOREIGN PATENT DOCUMENTS

| | | | |
|---|---|---|---|
| CN | 1668238 | A | 9/2005 |
| CN | 101161174 | A | 4/2008 |
| CN | 101297267 | A | 10/2008 |
| CN | 102083352 | A | 6/2011 |
| CN | 103027634 | | 4/2013 |
| CN | 103054516 | A | 4/2013 |
| CN | 103491838 | A | 1/2014 |
| CN | 103565373 | A | 2/2014 |
| DE | 3536907 | | 4/1986 |
| DE | 9307500 | | 7/1993 |
| DE | 4211789 | | 10/1993 |
| DE | 4340367 | | 6/1995 |
| DE | 4439427 | A1 | 5/1996 |
| DE | 19849978 | | 5/2000 |
| DE | 202008017137 | U1 | 3/2009 |
| DE | 102010000174 | | 7/2011 |
| DE | 102010000573 | | 9/2011 |
| DE | 102010037672 | | 3/2012 |
| EP | 0142594 | | 5/1985 |
| EP | 0358628 | | 3/1990 |
| EP | 0474542 | | 3/1992 |
| EP | 0569984 | | 11/1993 |
| EP | 0606173 | | 7/1994 |
| EP | 1099143 | | 11/2003 |
| EP | 1360922 | A2 | 11/2003 |
| EP | 1441271 | | 7/2004 |
| EP | 1331537 | | 8/2005 |
| EP | 2050380 | | 4/2009 |
| EP | 1969438 | | 9/2009 |
| EP | 1395888 | | 5/2011 |
| EP | 2316322 | | 5/2011 |
| EP | 2296005 | | 6/2011 |
| EP | 2251757 | | 11/2011 |
| EP | 2417894 | | 2/2012 |
| EP | 2438843 | | 4/2012 |
| EP | 2466411 | A2 | 6/2012 |
| EP | 2561787 | | 2/2013 |
| EP | 2578125 | | 4/2013 |
| EP | 2583609 | | 4/2013 |
| EP | 2604163 | | 6/2013 |
| EP | 2447800 | | 4/2014 |
| EP | 2741483 | | 6/2014 |
| EP | 2772815 | | 9/2014 |
| EP | 2884364 | A1 | 6/2015 |
| EP | 2992803 | A1 | 3/2016 |
| FR | 2999410 | | 6/2014 |
| GB | 2355523 | | 4/2001 |
| GB | 2382251 | | 5/2003 |
| GB | 2494446 | | 3/2013 |
| GB | 1447943 | | 10/2013 |
| JP | 5540959 | | 3/1980 |
| JP | 6286414 | | 4/1987 |
| JP | 62109528 | | 5/1987 |
| JP | 62120510 | | 6/1987 |
| JP | 62152421 | | 7/1987 |
| JP | 62152424 | | 7/1987 |
| JP | 63127310 | A | 5/1988 |
| JP | 63181727 | | 7/1988 |
| JP | 63241610 | | 10/1988 |
| JP | 03162814 | A | 7/1991 |
| JP | 03166074 | | 7/1991 |
| JP | 04260905 | | 9/1992 |
| JP | 0584200 | | 4/1993 |
| JP | 0584210 | | 4/1993 |
| JP | 05084200 | | 4/1993 |
| JP | 05189041 | | 7/1993 |
| JP | 05224745 | | 9/1993 |
| JP | 05228090 | | 9/1993 |
| JP | 064133 | | 1/1994 |
| JP | 0683442 | A | 3/1994 |
| JP | 06125861 | | 5/1994 |
| JP | 06144215 | | 5/1994 |
| JP | 06179145 | | 6/1994 |
| JP | 075922 | | 1/1995 |
| JP | 0759695 | | 3/1995 |
| JP | 0732752 | B2 | 4/1995 |
| JP | 07129239 | A | 5/1995 |
| JP | 07281742 | | 10/1995 |
| JP | 08089455 | | 4/1996 |
| JP | 08326025 | | 12/1996 |
| JP | 0944240 | | 2/1997 |
| JP | 09150741 | | 6/1997 |
| JP | 09185410 | | 7/1997 |

(56) References Cited

FOREIGN PATENT DOCUMENTS

| | | | |
|---|---|---|---|
| JP | 11267074 | | 10/1999 |
| JP | 2001022443 | | 1/2001 |
| JP | 2001187009 | | 7/2001 |
| JP | 2002182742 | A | 6/2002 |
| JP | 2002287824 | A | 10/2002 |
| JP | 2002355204 | | 12/2002 |
| JP | 2002366228 | | 12/2002 |
| JP | 2003280740 | | 10/2003 |
| JP | 2004096253 | | 3/2004 |
| JP | 2004166968 | | 6/2004 |
| JP | 2004198212 | | 7/2004 |
| JP | 2004303134 | A | 10/2004 |
| JP | 2005040597 | A | 2/2005 |
| JP | 2005124753 | A | 5/2005 |
| JP | 2005141636 | A | 6/2005 |
| JP | 2005314116 | A | 11/2005 |
| JP | 2006015113 | A | 1/2006 |
| JP | 2006087507 | | 4/2006 |
| JP | 2006185438 | A | 7/2006 |
| JP | 2006231477 | | 9/2006 |
| JP | 2006314669 | | 11/2006 |
| JP | 2007014369 | A | 1/2007 |
| JP | 2007070658 | | 3/2007 |
| JP | 2007143645 | A | 6/2007 |
| JP | 2007213236 | A | 8/2007 |
| JP | 2007226322 | A | 9/2007 |
| JP | 2007272665 | A | 10/2007 |
| JP | 2008132299 | A | 6/2008 |
| JP | 2008146617 | A | 6/2008 |
| JP | 2008290184 | | 12/2008 |
| JP | 2008543394 | A | 12/2008 |
| JP | 2009500741 | A | 1/2009 |
| JP | 2009509220 | | 3/2009 |
| JP | 2009193240 | A | 8/2009 |
| JP | 2010507169 | A | 3/2010 |
| JP | 2010079869 | A | 4/2010 |
| JP | 2010526594 | | 8/2010 |
| JP | 2010534825 | A | 11/2010 |
| JP | 2011045694 | | 3/2011 |
| JP | 2011253361 | A | 12/2011 |
| JP | 2012216051 | A | 11/2012 |
| JP | 2013041506 | A | 2/2013 |
| JP | 2013089256 | A | 5/2013 |
| JP | 2013247986 | A | 12/2013 |
| JP | 2014023930 | A | 2/2014 |
| KR | 20040096253 | | 11/2004 |
| KR | 20050003112 | | 1/2005 |
| KR | 20070070658 | | 7/2007 |
| KR | 20090028359 | | 3/2009 |
| KR | 101231932 | | 3/2013 |
| NL | 7408667 | | 1/1975 |
| WO | 8804081 | | 6/1988 |
| WO | 9303399 | | 2/1993 |
| WO | 9638770 | | 12/1996 |
| WO | 0036961 | | 6/2000 |
| WO | 0036970 | | 6/2000 |
| WO | 0038025 | | 6/2000 |
| WO | 0182766 | A2 | 11/2001 |
| WO | 03022120 | | 3/2003 |
| WO | 03024292 | | 3/2003 |
| WO | 03026474 | A2 | 4/2003 |
| WO | 2004006034 | A2 | 1/2004 |
| WO | 2004082899 | | 9/2004 |
| WO | 2007008148 | | 1/2007 |
| WO | 2007028049 | | 3/2007 |
| WO | 2007051972 | | 5/2007 |
| WO | 2007065034 | | 6/2007 |
| WO | 2008048260 | | 4/2008 |
| WO | 2009132317 | | 10/2009 |
| WO | 2013105431 | | 7/2013 |
| WO | 2013157324 | | 10/2013 |
| WO | 2014033055 | | 3/2014 |
| WO | 2014151501 | A1 | 9/2014 |
| WO | 2015016580 | | 2/2015 |

OTHER PUBLICATIONS

European Communication Pursuant to Article 94(3) for European Application No. 13817911.4, dated Jan. 15, 2018, 8 pages.
Non Final Office Action for U.S. Appl. No. 15/102,017, dated Feb. 16, 2018, 12 pages.
Non Final Office Action for U.S. Appl. No. 15/101,212, dated May 17, 2017, 8 pages.
Japanese Office Action forApplication for Japanese Application No. 2015-528969, dated Apr. 7, 2017 with translation, 4 pages.
Final Office Action for U.S. Appl. No. 14/409,291, dated Jun. 6, 2017, 21 pages.
Final Office Action for U.S. Appl. No. 15/102,017, dated Jun. 14, 2018, 12 pages.
Non Final Office Action for U.S. Appl. No. 15/101,235, dated Jun. 14, 2018, 11 pages.
Chinese Office Action for Chinese Application No. 201380081331.6, dated Mar. 26, 2018 with translation, 27 pages.
Decision of Refusal for Japanese Application No. 2016-526945, dated May 15, 2018 with translation, 5 pages.
Decision of Refusal for Japanese Application No. 2016-526875, dated May 15, 2018 with translation, 6 pages.
Notification of Reasons for Refusal for Japanese Application No. 2016-526765, dated May 15, 2018 with translation, 6 pages.
Non Final Office Action for U.S. Appl. No. 15/101,515, dated Apr. 18, 2018, 14 pages.
Notice of Allowance for U.S. Appl. No. 15/101,212, dated Apr. 11, 2018, 9 pages.
Final Office Action for U.S. Appl. No. 14/784,106, dated Mar. 28, 2018, 8 pages.
Final Office Action for U.S. Appl. No. 15/100,667, dated Mar. 27, 2018, 22 pages.
Notification of Reasons for Refusal for Japanese Application No. 2017-501374, dated Mar. 6, 2018 with translation, 8 pages.
Chinese Office Action for Chinese Application No. 201380081535.X, dated Mar. 26, 2018 with translation, 18 pages.
Chinese Office Action for Chinese Application No. 201380081103.9, dated Feb. 27, 2018 with translation, 19 pages.
Non Final Office Action for U.S. Appl. No. 15/101,235, dated Nov. 1, 2017, 11 pages.
Non Final Office Action for U.S. Appl. No. 15/100,667, dated Nov. 29, 2017, 22 pages.
Non Final Office Action for U.S. Appl. No. 14/784,106, dated Oct. 19, 2017, 11 pages.
Final Office Action for U.S. Appl. No. 15/101,212, dated Oct. 11, 2017, 7 pages.
Chinese Office Action for Chinese Application No. 201380075510.9, dated Oct. 27, 2017 with translation, 13 pages.
Notification of Reasons for Refusal for Japanese Application No. 2016-526945, dated Oct. 31, 2017 with translation, 8 pages.
Notification of Reasons for Refusal for Japanese Application No. 2016-526875, dated Oct. 31, 2017 with translation, 10 pages.
Notice of Reasons for Rejection for Japanese Application No. 2016-526947, dated Sep. 21, 2017 with translation, 8 pages.
Notice of Allowance for U.S. Appl. No. 15/102,015, dated Dec. 11, 2017, 8 pages.
Notice of Allowance for U.S. Appl. No. 14/409,291, dated Sep. 18, 2017, 8 pages.
Notice of Reasons for Rejection for Japanese Application No. 2016-526764, dated Aug. 25, 2017 with translation, 8 pages.
Notification fo Reasons for Rejection for Japanese Application No. 2016-526765, dated Aug. 25, 2017 with translation, 7 pages.
Notifcation of Reasons for Refusal for Japanese Application No. 2016-526756, dated Aug. 10, 2017 with translation, 6 pages.
Notification of Reasons for Refusal for Japanese Application No. 2016-526759, dated Aug. 24, 2017 with translation, 9 pages.
International Search Report and Written Opinion for International Application No. PCT/EP2016/055547, dated Jan. 2, 2017, 10 pages.
Notice of Allowance for U.S. Appl. No. 15/100,667, dated Aug. 6, 2018, 10 pages.
Non Final Office Action for U.S. Appl. No. 15/101,510, dated Jul. 27, 2018, 17 pages.

(56) References Cited

OTHER PUBLICATIONS

Non Final Office Action for U.S. Appl. No. 14/784,110, dated Aug. 16, 2018, 13 pages.
Chinese Office Action for Chinese Application No. 201380081537.9, dated Jun. 4, 2018 with translation, 15 pages.
"SM51 Series Opposed Mode Sensors, DC sensors with metal housings: SM51EB/RB, SM51EB6/RB6", Banner Engineering Corporation, pp. 1-24.
Andersson, et al., "ISR: An Intelligent Service Robot", Centre for Autonomous Systems, Royal Institute of Technology, S-100 44 Stockholm, Sweden, pp. 1-24.
Berlin, et al. "Development of a Multipurpose Mobile Robot for Concrete Surface Processing", A Status Report, Feb. 1992, Sweden, pp. 1-10.
Borenstein, et al. "Real-Time Obstacle Avoidance for Fast Mobile Robots", IEEE, Jan. 6, 1996, pp. 1-18.
Braunstingl, et al., "Fuzzy Logic Wall Following of a Mobile Robot Based on the Concept of General Perception", ICAR '95, 7th International Conference on Advanced Robotics, Sant Feliu De Guixols, Spain pp. 367-376., Sep. 1995, pp. 1-9.
Caselli, et al. "Mobile Robot Navigation in Enclosed Large-Scale Space", Italy and U.S.A., pp. 1-5.
Cassens, et al. "Finishing and Maintaining Wood Floors", Wood Finishing, North Central Regional Extension Publication #136, pp. 1-8.
Chinese Office Action for Chinese Application No. 20130075510.9, dated Feb. 6, 2017 with translation, 14pages.
Chinese Office Action for Chinese Application No. 201380075503.9, dated Feb. 13, 2017 with translation, 18 pages.
Chung etal.,"Path Planning for a Mobile Robot With Grid Type World Model", Proceedings of the 1992 IEEE/RSJ International Conference on Intelligent Robots and Systems, Jul. 7-10, 1992, pp. 439-444.
Collins, et al. "Cerebellar Control of a Line Following Robot", Computer Science and Electrical Engineering Department, University of Queensland, St.Lucia, Queensland, 4072 A, pp. 1-6.
Doty, et al. "Sweep Strategies for a Sensory-Driven, Behavior-Based Vacuum Cleaning Agent", 1993, Machine Intelligence Laboratory—Gainesville Florida, AAAI 1993 Fall Symposium Series—Research Triangle Park—Raleigh, NC, Oct. 22-24, 1993, pp. 1-6.
Everett, Sensors for Mobile Robots Theory and Application, A.K. Peters, 1995, Chapters 1 and 3, 70pages.
Everett, Sensors for Mobile Robots Theory and Application, A.K. Peters, Ltd., 1995, Chapters 15 and 16, 59pages.
Everett, Sensors for Mobile Robots Theory and Application, A.K. Peters, Ltd., 1995, Chapters 6, 7 and 10, 79pages.
Everett, Sensors for Mobile Robots Theory and Application, A.K. Peters, Ltd., 1995, Chapters, 4a nd 5, 68pages.
Everett, et al. "Survey of Collision Avoidance and Ranging Sensors for Mobile Robots", Revision 1, Technical Report 1194, Dec. 1992, pp. 1-154.
Extended European Search Report for European Application No. 16176479.0, dated Nov. 11, 2016, 9pages.
Final Office Action for U.S. Appl. No. 15/100,667, dated Apr. 21, 2017, 26 pages.
Gavrilut, et al., "Wall-Following Method for an Autonomous Mobile Robot using Two IR Sensors", 12th WSEAS International Conference on Systems, Heraklion, Greece, Jul. 22-24, 2008, ISBN: 978-960-6766-83-1, ISSN: 1790-2769, pp. 205-209.
Herbst, et al., "Micromouse Design Specifications", Jun. 2, 1998, pp. 1-22.
International Preliminary Report on Patentability for International Application No. PCT/EP2013/077377, dated Jun. 21, 2016, 12 pages.
International Preliminary Report on Patentability for International Application No. PCT/EP2013/077378, dated Jun. 21, 2016, 7 pages.
International Preliminary Report on Patentability for International Application No. PCT/EP2013/077384, dated Jun. 21, 2016, 6 pages.
International Preliminary Report on Patentability for International Application No. PCT/EP2013/077385, dated Jun. 21, 2016, 7 pages.
International Preliminary Report on Patentability for International Application No. PCT/EP2013/077386, dated Jun. 21, 2016, 6 pages.
International Preliminary Report on Patentability for International Application No. PCT/EP2013/077387, dated Jun. 21, 2016, 9 pages.
International Preliminary Report on Patentability for International Application No. PCT/EP2013/077657, dated Jun. 21, 2016, 7 pages.
International Preliminary Report on Patentability for International Application No. PCT/EP2013/077661, dated Jun. 21, 2016, 11 pages.
International Preliminary Report on Patentability for International Application No. PCT/EP203/077380, dated Jun. 21, 2016, 6 pages.
International Search Report and Written Opinion of the International Searching Authority fo rInternatonal Applicaion No. PCT/EP2014/0077142, dated Sep. 11, 2015, 8 pages.
International Search Report and Written Opinion of the International Searching Authority for International Application No. PCT/EP2014/069073, dated May 12, 2015, 10pages.
International Search Report and Written Opinion of the International Searching Authority for International Application No. PCT/Ep2012/077377, dated Nov. 6, 2014, 18 pages.
International Search Report and Written Opinion of the International Searching Authority for International Application No. PCT/EP2013/077378, dated Apr. 9, 2014, 9 pages.
International Search Report and Written Opinion of the International Searching Authority for International Application No. PCT/EP2013/077380, dated Jul. 28, 2014, 8 pages.
International Search Report and Written Opinion of the International Searching Authority for International Application No. PCT/EP2013/077384, dated Aug. 14, 2016, 9 pages.
International Search Report and Written Opinion of the International Searching Authority for International Application No. PCT/EP2013/077385, dated May 27, 2015, 9 pages.
International Search Report and Written Opinion of the International Searching Authority for International Application No. PCT/EP2013/077386, dated Sep. 17, 2014, 9 pages.
International Search Report and Written Opinion of the International Searching Authority for International Application No. PCT/EP2013/077387, dated Sep. 30, 2014, 12 pages.
International Search Report and Written Opinion of the International Searching Authority for International Application No. PCT/EP2013/077661, dated Jun. 10, 2014, 15 pages.
International Search Report and Written Opinion of the International Searching Authority for International Application No. PCT/EP2014/069074, dated May 11, 2015, 9 pages.
International Search Report and Written Opinion of the International Searching Authority for International Application No. PCT/EP2014/077549, dated Jul. 27, 2015, 9 pages.
International Search Report and Written Opinion of the International Searching Authority for International Application No. PCT/EP2014/077947, dated Jul. 11, 2016, 14 pages.
International Search Report and Written Opinion of the International Searching Authority for International Application No. PCT/EP2014/077954, dated Oct. 12, 2015, 19pages.
International Search Report and Written Opinion of the International Searching Authority for International Application No. PCT/EP2014/078144, 7 pages.
International Search Report and Written Opinion of the International Searching Authority for International Application No. PCT/EP32013/077657, dated Aug. 18, 2014, 10 pages.
International Search Report for International Application No. PCT/EP2013/057814 dated Dec. 20, 2013, 5pages.
International Search Report for International Application No. PCT/EP2013/057815 dated Apr. 12, 2014, 4 pages.
International Search Report for International Application No. PCT/EP2013/067500 dated Dec. 10, 2013, 4pages.
Japanese Office Action for Japanese Application No. 2016-506794, dated Feb. 7, 2017 with translation, 10 pages.
Japanese Office Action for Japanese Application No. 2016-506795 , dated Feb. 7, 2017 with translation, 6 pages.
Jenkins, "Practical Requirements for a Domestic Vacuum-Cleaning Robot", From: AAAI Technical Report FS-93-03., JRL Consulting, Menlo Park, California, pp. 85-90.

(56) References Cited

OTHER PUBLICATIONS

Jones et al., Mobile Robots Inspiration to Implementation, Second Edition, A.K. Peters, Ltd., 1999, Chapters 1 and 5, 72pages.
Jones etal., Mobile Robots Inspiration to Implementation, Second Edition, A.K. Peters ,Ltd., 1999, Chapters 6 and 9, 56pages.
Jones etal., Mobile Robots Inspiration to Implementation, Second Edition, A.K. Peters, Ltd., 1999, Chapters 10 and 11, 45pages.
Jung, et al. "Whisker Based Mobile Robot Navigation", Wollongong, NSW 2500, Australia, pp. 1-8.
Krishna, et al., "Solving the Local Minima Problem for a Mobile Robot by Classification of Spatio-Temporal Sensory Sequences", Journal of Robotic Systems 17 (10), 2000, pp. 549-564.
Kube, "A Minimal Infrared Obstacle Detection Scheme", Department of Computing Science, University of Alberta, Edmonton, Alberta, Canada, The Robotics Practitioner, 2(2): 15 20, 1996, Oct. 23, 1998, pp. 1-8.
Larson, "RoboKent—a case study in man-machine interfaces" Industrial Robot, vol. 25 No. 2, 1998, pp. 95-100.
LeBouthillier, "W. Grey Walter and his Turtle Robots", The Robot Builder, vol. 11 No. 5, May 1999, RSSC POB 26044, Santa Ana,CA, pp. 1-8.
Maaref,etal."Sensor-based navigation of a mobile robot in an indoor environment", Robotics and Autonomous Systems, 2002, Elsevier, 18pages.
Michael Carsten Bosse, "Atlas: A Framework for Large Scale Automated Mapping and Localization", Massachusetts Institute of Technology, Feb. 2004, Part 2, 67 pages.
Michael Carsten Bosse, "Atlas: A Framework for Large Scale Automated Mapping and Localization", Massachusetts Institute of Technology, Feb. 2004, Part 1, 140 pages.
Non Final Office Action for U.S. Appl. No. 14/409,291, dated Dec. 28, 2016, 61pages.
Non Final Office Action for U.S. Appl. No. 15/100,667, dated Sep. 12, 2016, 24 pages.
Non Final Office Action for U.S. Appl. No. 15/101,235 dated Apr. 21, 2017, 10 pages.
Non Final Office Action for U.S. Appl. No. 15/101,257, dated Feb. 10, 2017, 10 pages.
Notice of Allowance for U.S. Appl. No. 14/409,291, dated Jun. 16, 2016, 13 pages.
Oren, Reply to Office Action dated Jun. 23, 2014, U.S. Appl. No. 13/757,985, pp. 1-10.
Pack, et al., "Constructing a Wall-Follower Robot for a Senior Design Project", 1996 ASEE Annual Conference Proceedings, Session 1532, pp. 1-7.
Saffiotti, "Fuzzy logic in Autonomous Robot Navigation", a case study, Nov. 1995 Revised: Aug. 1997, IRIDIA, Universite Libre de Bruxelles, Belgium, , Technical Report TR/IRIDIA/ 95 25, Cover page + pp. 1-14.
Written Opinion for International Application No. PCT/EP2013/067500 dated Dec. 10, 2013, 7pages.
Yamamoto, "SOZZY: A Hormone-Driven Autonomous Vacuum Cleaner", From: AAAI Technical Report FS-93-03, Matasushita Research Institute, Tokyo, and MIT Artificial Intelligence laboratory, Massachusetts, pp. 116-124 + Figure 9 and Figure 11.
Chinese Office Action for Chinese Application No. 201380075503.9, dated Nov. 8, 2017 with translation, 16 pages.
European Communication Pursuant to Article 94(3) for European Application No. 16176479.0, dated Nov. 27, 2017, 6 pages.
Notice of Allowance for U.S. Appl. No. 15/101,257, dated Jul. 6, 2017, 9 pages.
International Search Report and Written Opinion of the International Searching Authority for International Application No. PCT/EP2015/058377, dated Aug. 10, 2016, 15 pages.
Non Final Office Action for U.S. Appl. No. 15/102,015, dated Aug. 17, 2017, 13 pages.
Notification of Reasons for Refusal of Japanese Application No. 2016-568949, dated Oct. 9, 2018 with translation, 6 pages.
Notice of Allowance for U.S. Appl. No. 15/102,295, dated Sep. 24, 2018, 9 pages.
Notice of Allowance for U.S. Appl. No. 15/101,515, dated Aug. 28, 2018, 11 pages.
International Search Report and Written Opinion of the International Searching Authority for International Application No. PCT/EP2016/060565, dated Feb. 15, 2017, 12 pages.
International Search Report and Written Opinion of the International Searching Authority for International Application No. PCT/EP2016/060571, dated Feb. 7, 2017, 8 pages.
Notice of Allowance for U.S. Appl. No. 14/784,106, dated Oct. 11, 2018, 7 pages.
Non Final Office Action for U.S. Appl. No. 15/321,333, dated Oct. 24, 2018, 10 pages.
Position_Definition of Position by Merriam-Webster.pdf (Position | Definition of Position by Merriam-Webster, Oct. 16, 2018, Merriam-Webster, https://www.merriam-webster.com/dictionary/position, pp. 1-15.
Gutman et al., AMOS: Comparison of Scan Matching Approaches for Self-Localization in Indoor Environments, 1996, IEEE, pp. 61-67.
Non Final Office Action for U.S. Appl. No. 15/504,066, dated Nov. 5, 2018, 18 pages.
Extended European Search Report for European Application No. 18157403.9, dated Nov. 14, 2018, 12 pages.
Report of Reconsideration by Examiner before Appeal for Japanese Application No. 2016-526875, dated Oct. 24, 2018, 2 pages.
Final Office Action for U.S. Appl. No. 15/101,235, dated Jan. 11, 2019, 12 pages.
Non Final Office Action for U.S. Appl. No. 15/102,017, dated Jan. 22, 2019, 15 pages.
Final Office Action for U.S. Appl. No. 15/101,510, dated Feb. 8, 2019, 16 pages.
Final Office Action for U.S. Appl. No. 15/504,066, dated Mar. 21, 2019, 18 pages.
Chinese Office Action for Chinese Application No. 201380081103.9, dated Jun. 6, 2019 with translation, 10 pages.
Notice of Allowance for U.S. Appl. No. 15/101,510, dated May 30, 2019, 12 pages.
Non Final Office Action for U.S. Appl. No. 15/534,591, dated Aug. 9, 2019, 11 pages.
Notice of Allowance for U.S. Appl. No. 15/504,066, dated Aug. 9, 2019, 8 pages.
Final Office Action for U.S. Appl. No. 15/534,591, dated Dec. 2, 2019, 12 pages.

* cited by examiner

ROBOTIC VACUUM CLEANER

This application is a U.S. National Phase application of PCT International Application No. PCT/EP2014/069074, filed Sep. 8, 2014, which is incorporated by reference herein.

TECHNICAL FIELD

The present invention relates to robotic vacuum cleaner.

BACKGROUND

A robotic vacuum cleaner forms of a self-propelling unit provided with a drive arrangement comprising a control system configured to control a movement of the robotic vacuum cleaner along a surface to be cleaned. The control system may comprise one or more sensors providing input to assist in controlling the movement of the robotic vacuum cleaner. A vacuum producing unit of the robotic vacuum cleaner is arranged in fluid communication with an opening of a nozzle inlet facing the surface to be cleaned. Debris sucked or otherwise propelled into the opening is directed into a debris receptacle of the robotic vacuum cleaner. The debris receptacle is emptied, or replaced, when filled with debris to a certain degree.

Since a robotic vacuum cleaner is to move freely about a surface to be cleaned it would be limited in its movements by an electric cord. Thus, a robotic vacuum cleaner is battery powered and the cleaning capability of a robotic vacuum cleaner has to be designed with the capacity of the on-board battery in mind. Accordingly, the drive arrangement, the capacity of the vacuum producing unit, the use of various rotating brushes, etc. affect consumption of electric power and thus, the design of a robotic vacuum cleaner.

Some robotic vacuum cleaners are provided with a rotatable side brush extending beyond a housing of the robotic vacuum cleaner. The rotatable side brush is arranged to brush debris from an area beside the housing and the nozzle inlet to the nozzle inlet, or at least within reach of a suction produced around the nozzle inlet by the vacuum producing unit.

Such a rotatable side brush should not impede the movement of the robotic vacuum cleaner. Thus, in a robotic vacuum cleaner comprising a rotatable side brush, design considerations include selecting a position of the rotatable side brush to not hinder the movement of the robotic vacuum cleaner, and selecting a clearance to the surface to be cleaned to permit the rotatable side brush to rotate more or less freely underneath the housing of the robotic vacuum cleaner. Accordingly, the position of the rotatable side brush and the clearance to the surface to be cleaned may not be optimal from a cleaning efficiency perspective. Moreover, use of a rotatable side brush may influence other design measures affecting the cleaning capacity of the robotic vacuum cleaner, or the battery capacity of the robotic vacuum cleaner.

SUMMARY

It is an object of the present invention to provide a robotic vacuum cleaner comprising a rotatable side brush, which robotic vacuum cleaner alleviates at least one of the above-mentioned problems.

According to an aspect of the invention, the object is achieved by a robotic vacuum cleaner comprising a housing, a drive arrangement being configured to drive the vacuum cleaner along a surface to be cleaned, a vacuum producing unit, a debris receptacle, a nozzle inlet facing the surface to be cleaned, and a rotatable side brush having a rotation axis. The rotatable side brush comprises bristles extending in a direction substantially outwardly from the rotation axis and extending substantially in parallel with the surface to be cleaned. The nozzle inlet comprises a frame structure forming an opening. The opening is arranged in fluid communication with the debris receptacle. The bristles extend to a lateral portion of the housing and over a side portion of the nozzle inlet. The frame structure comprises a base portion extending substantially in parallel with the surface to be cleaned. The base portion extends at a first level. The frame structure at the side portion of the nozzle inlet extends substantially in parallel with the surface to be cleaned at a second level, wherein the first level is arranged closer to the surface to be cleaned than the second level.

Since the base portion of the frame structure extends at the first level and the frame structure at the side portion of the nozzle inlet extends at the second level and the first level is arranged closer to the surface to be cleaned than the second level, a larger distance between the frame structure and the surface to be cleaned is provided at the side portion than at the base portion extending at the first level. Thus, space is provided for at least a portion of the rotatable side brush at the nozzle inlet and the movement of the robotic vacuum cleaner is not affected, or at least affected to a lesser extent, by the rotatable side brush. As a result, the above mentioned object is achieved. Moreover, due to the side portion being arranged at the second level, the rotatable side brush may easily propel larger debris such as sand and small stones into the opening at the side portion.

It is understood that the first level is arranged closer to the surface to be cleaned than the second level in use of the robotic vacuum cleaner. The robotic vacuum cleaner may be a self-propelling unit. The drive arrangement may comprise one or more wheels, of which at least one wheel is directly or indirectly driven by an electric drive motor. The drive arrangement may further comprise a control system configured to control the electric drive motor to move the robotic vacuum cleaner about the surface to be cleaned. The control system may comprise one or more sensors to provide input assisting in controlling the movement of the robotic vacuum cleaner. The at least one sensor may be of one or more different kinds, such as e.g. an infrared sensor, a laser sensor, an ultrasonic sensor, or a contact sensor. The vacuum producing unit may comprise a fan driven by an electric fan motor. The opening may be arranged in fluid communication with the debris receptacle via a debris conduit system. The vacuum producing unit may be arranged in fluid communication with the opening via the debris conduit system and optionally also the debris receptacle, i.e. the vacuum producing unit in some embodiments may create a suction from the opening of the nozzle inlet via the debris conduit system to the debris receptacle. In use of the robotic vacuum cleaner the leading edge portion of the frame structure travels ahead of the trailing edge portion in most cleaning situations. In addition to the rotatable side brush, the robotic vacuum cleaner may comprise one or more further rotatable brushes assisting in propelling debris towards, or into, the opening of the nozzle inlet. The rotatable side brush and such further rotatable brushes may be driven by one or more electric brush motors. Besides controlling the drive motor, the control system may also control the fan motor and/or the one or more brush motors. The robotic vacuum cleaner may comprise one or more rechargeable batteries configured to power the drive arrangement including the control system and the various electric motors.

According to embodiments, the side portion may extend from a lateral end of the nozzle inlet towards a centre of the nozzle inlet. Thus, the side portion may form an outer end portion of the nozzle inlet.

According to embodiments, the first level may extend at a distance of less than 2 mm from the surface to be cleaned. In this manner the vacuum producing unit may produce a substantial suction force in an area around the base portion of the frame structure, which base portion is arranged at the first level, and no protruding element, such as a resilient ridge, extending along a portion of the opening may be required to reduce the amount of air flowing into the opening. Due to the side portion extending at the second level thus, providing space for the rotatable side brush at the opening, the first level and the base portion may extend at the stipulated distance of less than 2 mm from the surface to be cleaned. The distance between the first level and the surface to be cleaned is measured when the robotic vacuum cleaner is standing on a firm surface such as a hardwood flooring.

According to embodiments, the base portion may be that part of the nozzle inlet which extends closest to the surface to be cleaned. In this manner the nozzle inlet may not require any protruding element, such as a resilient ridge, extending along a portion of the opening to produce sufficient suction in an area around the base portion.

According to embodiments, the frame structure may comprise a leading edge portion, and at least a portion of the leading edge portion may provide a smooth transition between the second level and the first level. In this manner the leading edge portion may slide over a vertical transition of the surface to be cleaned, such as when the robotic vacuum cleaner transits from a bare floor surface onto a carpet or over a doorsill.

According to embodiments, the frame structure may comprise at least one cross brace extending from the leading edge portion to a trailing edge portion of the frame structure. In this manner elongated objects, such as cables, may be prevented from being caught in the opening.

According to embodiments, the at least one cross brace may form part of the base portion and may extend at the first level. In this manner the cross brace may prevent the trailing edge from abutting, in the opening, against a vertical transition of the surface to be cleaned, such as a carpet edge. This could otherwise prevent the robotic vacuum cleaner from continuing traveling forwardly.

According to embodiments, the robotic vacuum cleaner may comprising a rotatable elongated brush roll arranged inside the housing and extending along the nozzle inlet including the side portion. The elongated brush roll may comprise radially extending members, wherein a first radially extending member of the radially extending members may extend from inside the housing at least to the first level. In this manner the elongated brush roll may assist the rotatable side brush in propelling in particular larger debris, such as sand and small stones, into the opening.

According to embodiments, the bristles of the rotatable side brush may extend at least partially at the second level or at least partially between the second level and the first level. In this manner the bristles of the side brush may be cleaned by the first radially extending member of the elongated brush roll as it extends across the second level to the first level. More specifically, as the elongated brush roll rotates, the first radially extending member may brush against the bristles of the rotatable side brush and since the rotatable side brush also rotates all the bristles of the rotatable side brush may be cleaned by the first radially extending member.

According to embodiments, the first radially extending member may comprises a resilient lip. In this manner a member stiffer than the bristles of the rotatable side brush may be provided. This may facilitate the cleaning of the bristles of the rotatable side brush.

According to embodiments, a first brush motor may drive the rotatable side brush and a second brush motor may drive the rotatable elongated brush roll. A rotation of the rotatable side brush may be individually controllable of a rotation of the rotatable elongated brush roll. In this manner each of the elongated brush roll and the rotatable side brush may be rotated at a speed and/or in a direction most suited for a particular cleaning situation of the robotic vacuum cleaner. The cleaning situation may be influenced e.g. by the type of surface being cleaned, the direction of travel of the robotic vacuum cleaner, and/or the proximity to vertical surfaces such as walls of a room.

According to embodiments, the rotatable side brush may be rotatable in two directions. In this manner the rotatable side brush may be rotated in a direction most suited for a particular direction of travel of the robotic vacuum cleaner. Moreover, the direction of rotation of the rotatable side brush may be changed to suit a rotation direction of the elongated brush roll. Further, the direction of rotation of the rotatable side brush may be changed to improve cleaning of the bristles by the elongated brush roll.

According to embodiments, the bristles of the rotatable side brush may extend beyond the side portion of the nozzle inlet. Since beyond the side portion the bristles of the rotatable side brush extend at a larger diameter than at the side portion, the bristles are arranged less dense at the larger diameter than at the side portion. Thus, it has been realized by the inventors that the frame structure extending at the second level in the side portion where the bristles are arranged more densely, may be sufficient to provide the advantages of the invention, as discussed above, also with a rotatable side brush comprising bristles extending beyond the side portion.

According to embodiments, the vacuum producing unit may be arranged in fluid communication with the opening. In such embodiments, due to the base portion being arranged at the first level, an efficient suction may be produced around the nozzle inlet by the vacuum producing unit, while the rotatable side brush may rotate at the side portion arranged at the second level, impeded to a lesser degree compared to if the entire frame structure would be arranged at the first level.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout.

Well-known functions or constructions will not necessarily be described in detail for brevity and/or clarity.

Figure 1:
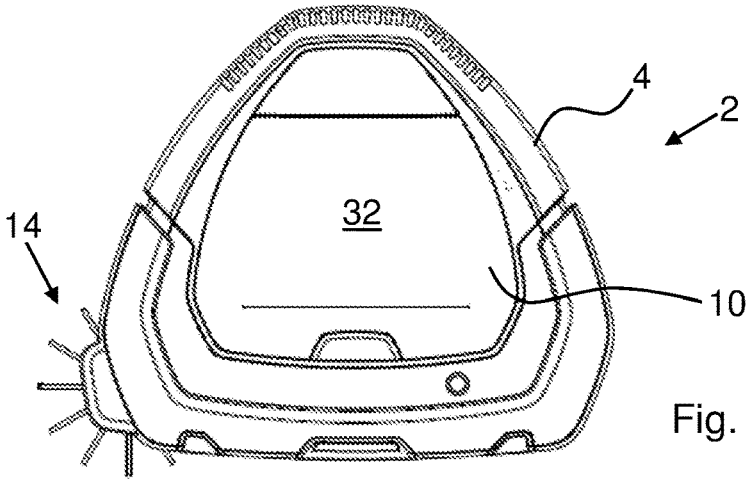
FIGS. 1 and 2 illustrate a top view and a perspective bottom view of a robotic vacuum cleaner according to embodiments.
Figure 2:
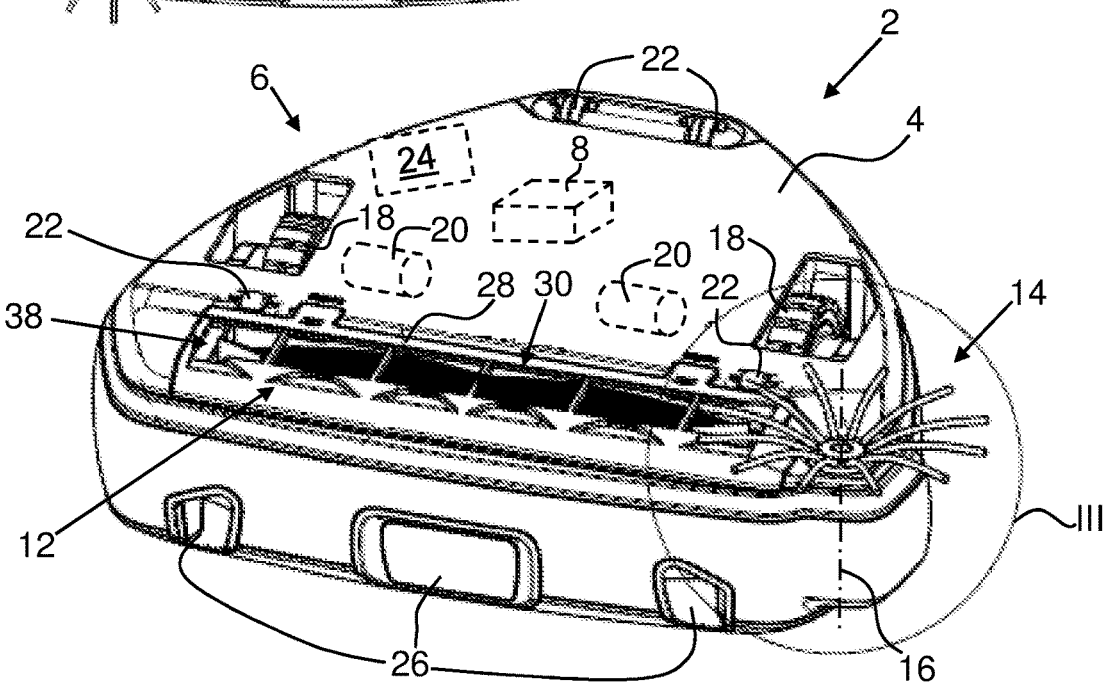

FIGS. 1 and 2 illustrate a top view and a perspective bottom view of a robotic vacuum cleaner 2 according to embodiments. The robotic vacuum cleaner 2 comprises a housing 4, a drive arrangement 6 configured to drive the vacuum cleaner 2 along a surface to be cleaned, a vacuum producing unit 8 (schematically illustrated), a debris receptacle 10, a nozzle inlet 12 facing the surface to be cleaned, and a rotatable side brush 14 having a rotation axis 16.

The drive arrangement 6 ensures that the robotic vacuum cleaner is a self-propelling unit. The drive arrangement 6 comprises two wheels 18 driven by electric drive motors 20, (schematically illustrated). The drive arrangement 6 comprises non-driven supporting wheels 22. The drive arrangement 6 also comprises a control system 24 (schematically illustrated) configured to control the electric drive motors 20. The control system 24 comprises sensors 26 assisting in controlling the movement of the robotic vacuum cleaner 2.

The debris receptacle 10 is arranged in the housing 4. One side portion 32 of the debris receptacle 10 forms an outer surface portion of the robotic vacuum cleaner 2. Thus, the debris receptacle 10 is easily accessible and removable by a user for emptying thereof. The nozzle inlet 12 is elongated and extends in parallel with a rotation axis of the two driven wheels 18. Thus, the nozzle inlet extends across a travelling direction of the robotic vacuum cleaner 2 for broad cleaning coverage. The nozzle inlet 12 comprises a frame structure 28 forming an opening 30. The opening 30 is arranged in fluid communication with the debris receptacle 10 and the vacuum producing unit 8 is arranged in fluid communication with the opening 30. Thus, the vacuum producing unit 8 may produce a suction force at the opening 30 to transport debris from an area around the opening 30 via a debris conduit system to the debris receptacle 10.

Figure 3A:
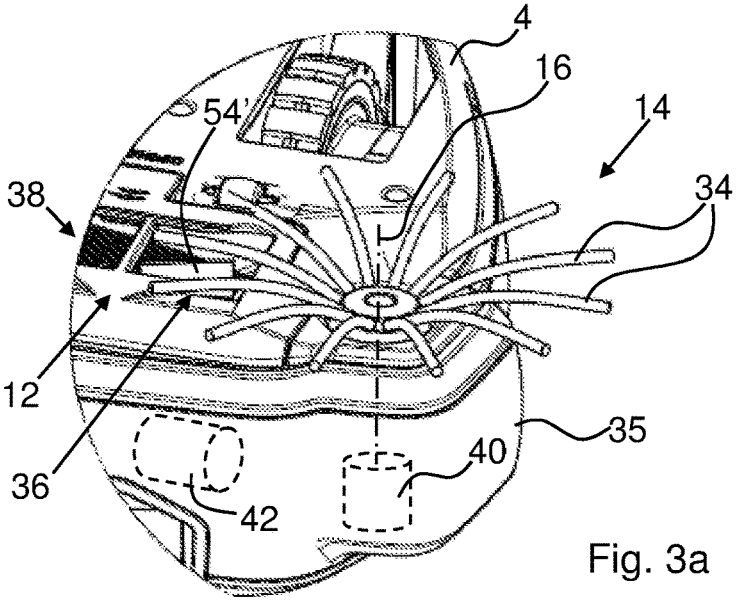
FIGS. 3*a* and 3*b* illustrate a partial enlargement of the robotic vacuum cleaner illustrated in FIG. 2.

FIG. 3*a* illustrates an enlargement of the encircled area III of FIG. 2. The rotatable side brush 14 comprises bristles 34 extending in a direction substantially outwardly from the rotation axis 16 and extending substantially in parallel with the surface to be cleaned. The bristles 34 extend to, and beyond, a lateral portion 35 of the housing 4 and over a side portion 36 of the nozzle inlet 12. The bristles 34 have been illustrated schematically in FIG. 3*a*. In practice the bristles 34 may be considerably thinner than illustrated and the rotatable side brush 14 may be provided with a considerably larger number of bristles 34 than illustrated. In the illustrated embodiments, the bristles 34 of the rotatable side brush 14 extend beyond the side portion 36 of the nozzle inlet 12. In alternative embodiments, the bristles 34 may extend only over the side portion 36 of the nozzle inlet 12. In such embodiments the position of the rotatable side brush 14 and/or the lateral portion 35 of the housing 4 may be configured such that the bristles 34 extend at least to the lateral portion 35 or beyond the lateral portion 35. The bristles 34 may extend substantially radially as illustrated in FIG. 3*a*. Alternatively, some or all of the bristles 34 may extend at an angle to a radial direction. The robotic vacuum cleaner 2 comprises a rotatable elongated brush roll 38 arranged inside the housing 4 and extending along the nozzle inlet 12 including the side portion 36 of the nozzle inlet 12, see also FIG. 2.

A first brush motor 40 (schematically illustrated) drives the rotatable side brush 14 and a second brush motor 42 drives the rotatable elongated brush roll 38. A rotation of the rotatable side brush 14 is individually controllable of a rotation of the rotatable elongated brush roll 38. The control system 24 may be configured to drive the first and second brush motors 40, 42. Due to the provision of two separate brush motors 40, 42 the rotations of the rotatable side brush 14 and the elongated brush roll 38 are individually controllable. The rotatable side brush 14 is rotatable in two directions by the first brush motor 40.

Figure 3B:
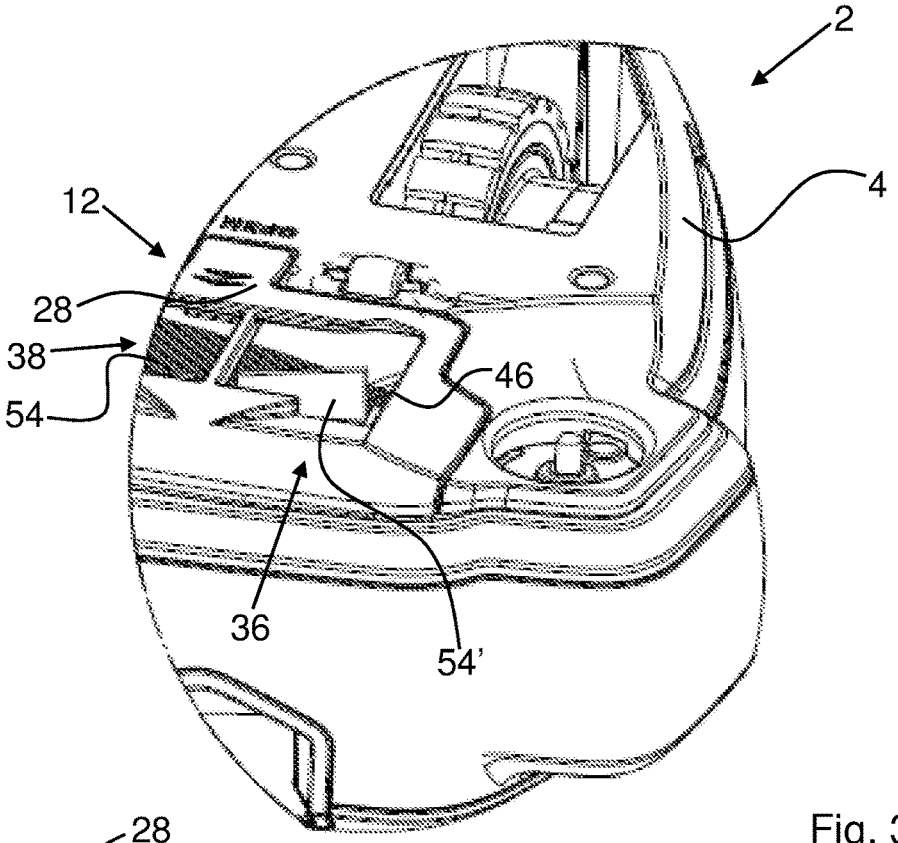
Figure 4:
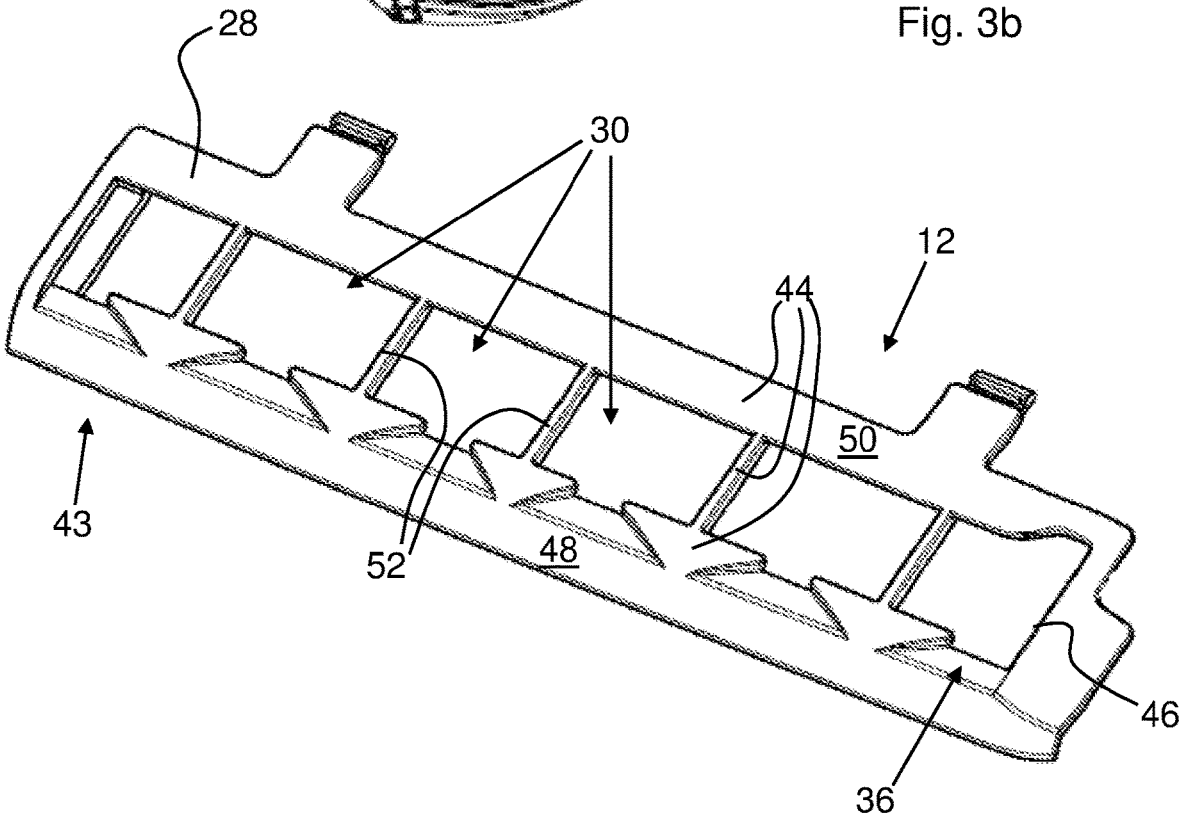
FIG. 4 illustrates a nozzle inlet of the robotic vacuum cleaner.

FIG. 3*b* illustrates the same area III of FIG. 2 as in FIG. 3*a* but with the rotatable side brush removed for the sake of clarity. FIG. 4 illustrates the nozzle inlet 12 of the robotic vacuum cleaner 2 shown in FIG. 2 in greater detail. In these embodiments, the nozzle inlet 12 is comprised in a removable lid 43 configured to be positioned in the housing 4 of the robotic vacuum cleaner 2. In alternative embodiments, the nozzle inlet 12 may be formed directly in the housing 4.

As mentioned above, the nozzle inlet 12 comprises a frame structure 28 forming an opening 30. The frame structure 28 comprises a base portion 44, which in use of the robotic vacuum cleaner 2 extends substantially in parallel with the surface to be cleaned. In use of the robotic vacuum cleaner 2 the base portion 44 extends at a first level. The frame structure 28, at the side portion 36 of the nozzle inlet 12, in use of the robotic vacuum cleaner 2 extends substantially in parallel with the surface to be cleaned at a second level. Accordingly, in use of the robotic vacuum cleaner 2 the first level is arranged closer to the surface to be cleaned than the second level. The side portion 36 extends from a lateral end 46 of the nozzle inlet 12 towards a centre of the nozzle inlet 12.

In use of the robotic vacuum cleaner 2, the first level, i.e. the base portion 44, may extend at a distance of less than 2 mm from the surface to be cleaned. Moreover, the base portion 44 may be that part of the nozzle inlet 12 and the housing 4, which extends closest to the surface to be cleaned in use of the robotic vacuum cleaner. Mentioned purely as an example, a distance between the first and second levels may be between 1-8 mm.

The frame structure 28 comprises a leading edge portion 48 and a trailing edge portion 50. It is clearly visible in FIGS. 3*a* and 4 that the side portion 36 extends at a different level than the base portion 44, i.e. at the second level. Also at the lateral end 46 and at the trailing edge portion 50 of the side portion 36 the side portion 36 extends at the second level. From the lateral end 46 the frame structure 28 is sloped towards a portion of the housing 4 arranged to receive the rotatable side brush. As also clearly visible in FIG. 4, the leading edge portion 48 comprises a number of portions extending at the second level. In these embodiments the leading edge portion 48 comprises six portions extending at the second level, including at the side portion 36. Alternatively, the leading edge portion 48 may comprise a different number of portions extending at the second level, such as 2-5 portions or 7-10 portions. Thus, in use of the robotic vacuum cleaner space may be provided for larger debris to enter the opening 30. At least a portion of the leading edge portion 48 provides a smooth transition between the second level and the first level. In these embodiments the leading edge portion comprises triangularly shaped portions, which slant from the second level to the first level, i.e. from the second level of the leading edge portion 48 to the base portion 44 at the first level.

The frame structure 28 comprises at least one cross brace 52 extending from the leading edge portion 48 to the trailing edge portion 50 of the frame structure 28. In these embodiments the frame structure comprises five cross braces 52. The at least one cross brace 52 forms part of the base portion 44 and accordingly, extends at the first level.

The trailing edge portion 50 forms part of the base portion 44 and part of the side portion 36. Accordingly, at the base portion 44 the trailing edge portion 50 extends at the first level and at the side portion 36 the trailing edge portion 50 extends at the second level. The trailing edge portion 50 may be formed only by a portion of the base portion 44, a portion of the side portion, and a transitional portion between the base portion 44 and the side portion 36.

Referring to FIGS. 3*a* and 3*b*, the elongated brush roll 38 comprises radially extending members 54, wherein a first radially extending member 54' of the radially extending members 54 extends from inside the housing 4 at least to the first level i.e. when the first radially extending member 54' is positioned centrally in the opening 30 during one revolution of the elongated brush roll 38. The radially extending members 54 may extend along one or more helical paths along the elongated brush roll 38. The first radially extending member 54' comprises a resilient lip. Other radially extending members 54 may comprise bristles. Alternatively, all radially extending members 54 may comprise resilient lips or bristles.

The bristles 34 of the side brush 14 extend at least partially at the second level or at least partially between the second level and the first level. Thus, the bristles 34 may be cleaned by the first radially extending member 54' of the elongated brush roll 38 as the rotatable side brush 14 and the elongated brush roll 38 rotate.

This invention should not be construed as limited to the embodiments set forth herein. A person skilled in the art will realize that different features of the embodiments disclosed herein may be combined to create embodiments other than those described herein, without departing from the scope of the present invention, as defined by the appended claims. Although the invention has been described with reference to example embodiments, many different alterations, modifications and the like will become apparent for those skilled in the art. For instance, the vacuum producing unit 8 may be switched off during some cleaning operations such that the elongated brush roll 38 and/or the rotatable side brush 14 propel debris into the debris receptacle 10 without assistance of vacuum. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A robotic vacuum cleaner comprising:

a housing;

a drive arrangement configured to drive the vacuum cleaner in a forward direction along a surface to be cleaned;

a vacuum producing unit;

a debris receptacle;

a nozzle inlet facing the surface to be cleaned, the nozzle inlet comprising a frame structure having:

an opening in fluid communication with the debris receptacle, the opening extending in a lateral direction that is perpendicular to the forward direction, a base portion adjacent the opening and facing the surface to be cleaned, the base portion extending along a first plane that is substantially parallel with the surface to be cleaned, a side portion extending in the lateral direction from a lateral end of the opening to a lateral portion of the housing, the lateral end of the opening defines a lateral boundary of the opening, the side portion comprising:

a sloped region begins sloping from the lateral end of the opening and continues to slope towards the lateral portion of the housing, and a side brush mounting region extending from the sloped region towards the lateral portion of the housing, wherein the side brush mounting region extends in a second plane that is substantially parallel with the surface to be cleaned, the second plane being further from the surface to be cleaned than the first plane, and the sloped portion is sloped away from the first plane starting at the lateral end of the opening and ending at the side brush mounting region; and a rotatable side brush mounted in the side brush mounting region and having a rotation axis, the rotatable side brush comprising bristles extending in a direction substantially outwardly from the rotation axis and substantially in parallel with the surface to be cleaned, and wherein during rotation of the rotatable side brush the bristles extend at least to the lateral portion of the housing and to the lateral end of the opening.

2. The robotic vacuum cleaner according to claim 1, wherein the first level extends at a distance of less than 2 mm from the surface to be cleaned.

3. The robotic vacuum cleaner according to claim 1, wherein the base portion is that part of the nozzle inlet which extends closest to the surface to be cleaned.

4. The robotic vacuum cleaner according to claim 1, further comprising at least one cross brace extending from a leading edge portion of the opening to a trailing edge portion of the opening.

5. The robotic vacuum cleaner according to claim 4, wherein the at least one cross brace forms part of the base portion and extends at the first level.

6. The robotic vacuum cleaner according to claim 1, further comprising a rotatable elongated brush roll arranged inside the housing and extending along the nozzle inlet, the elongated brush roll comprising radially extending members, wherein during rotation of the elongated brush roll a first radially extending member of the radially extending members extends from inside the housing at least to the first level.

7. The robotic vacuum cleaner according to claim 6, wherein the bristles of the rotatable side brush extend at least partially at the second level or at least partially between the second level and the first level.

8. The robotic vacuum cleaner according to claim 6, wherein the first radially extending member comprises a resilient lip.

9. The robotic vacuum cleaner according to claim 6, wherein a first brush motor drives the rotatable side brush and a second brush motor drives the rotatable elongated brush roll, and wherein a rotation of the rotatable side brush is individually controllable of a rotation of the rotatable elongated brush roll.

10. The robotic vacuum cleaner according to claim 6, wherein the first radially extending member cleans the bristles of the side brush during rotation of the elongated brush roll and the side brush.

11. The robotic vacuum cleaner according to claim 1, wherein the rotatable side brush is rotatable in two directions.

12. The robotic vacuum cleaner according to claim 1, wherein the bristles of the rotatable side brush extend beyond the lateral end of the nozzle inlet during rotation of the side brush.

13. The robotic vacuum cleaner according to claim 1, wherein the vacuum producing unit is arranged in fluid communication with the opening.

14. The robotic vacuum cleaner according to claim 1, further comprising:

a recess located in the side brush mounting region, and wherein a portion of the rotatable side brush is positioned in the recess.

* * * * *